US009790440B2

(12) United States Patent
Chang

(10) Patent No.: US 9,790,440 B2
(45) Date of Patent: Oct. 17, 2017

(54) METHODS FOR INCREASING CATALYST CONCENTRATION IN HEAVY OIL AND/OR COAL RESID HYDROCRACKER

(75) Inventor: Yu-Hwa Chang, West Windsor, NJ (US)

(73) Assignee: HEADWATERS TECHNOLOGY INNOVATION GROUP, INC., South Jordan, UT (US)

( * ) Notice: Subject to any disclaimer, the term of this patent is extended or adjusted under 35 U.S.C. 154(b) by 1203 days.

(21) Appl. No.: 13/242,979

(22) Filed: Sep. 23, 2011

(65) Prior Publication Data

US 2013/0075304 A1 Mar. 28, 2013

(51) Int. Cl.

*C10G 65/10* (2006.01)
*C10G 47/06* (2006.01)
*C10G 47/26* (2006.01)

(52) U.S. Cl.

CPC ..... *C10G 47/06* (2013.01); *C10G 47/26* (2013.01); *C10G 65/10* (2013.01); *C10G 2300/802* (2013.01)

(58) Field of Classification Search

CPC ..... C10G 65/10
See application file for complete search history.

(56) References Cited

U.S. PATENT DOCUMENTS

| | | | |
|---|---|---|---|
| 2,850,552 | A | 9/1958 | Ogle |
| 3,019,180 | A | 2/1959 | Schreiener et al. |
| 3,161,585 | A | 12/1964 | Gleim et al. |
| 3,254,017 | A | 5/1966 | Arey, Jr. et al. |
| 3,267,021 | A | 8/1966 | Gould |
| 3,297,563 | A | 1/1967 | Doumani |
| 3,349,713 | A | 10/1967 | Fassbender |
| 3,362,972 | A | 1/1968 | Kollar |
| 3,578,690 | A | 5/1971 | Becker |
| 3,595,891 | A | 7/1971 | Cavitt |
| 3,622,497 | A | 11/1971 | Gleim |
| 3,622,498 | A | 11/1971 | Stolfa et al. |
| 3,694,351 | A | 9/1972 | White |
| 3,694,352 | A | 9/1972 | Gleim |
| 3,816,020 | A | 6/1974 | Ogles |
| 3,870,623 | A | 3/1975 | Johnson et al. |
| 3,892,389 | A | 7/1975 | Conastin |
| 3,915,842 | A | 10/1975 | Gatsis |
| 3,919,074 | A | 11/1975 | Gatsis |
| 3,953,362 | A | 4/1976 | Lines et al. |
| 3,983,028 | A | 9/1976 | McCollum et al. |
| 3,992,285 | A | 11/1976 | Hutchings |
| 4,022,681 | A | 5/1977 | Sheng et al. |
| 4,066,530 | A | 1/1978 | Aldridge et al. |
| 4,066,561 | A | 1/1978 | Nnadi |
| 4,067,798 | A | 1/1978 | Hauschildt et al. |
| 4,067,799 | A | 1/1978 | Bearden, Jr. et al. |
| 4,068,830 | A | 1/1978 | Gray |
| 4,077,867 | A | 3/1978 | Aldridge et al. |
| 4,083,803 | A | 4/1978 | Oswald et al. |
| 4,125,455 | A | 11/1978 | Herbstman |
| 4,134,825 | A | 1/1979 | Bearden, Jr. et al. |
| 4,148,750 | A | 4/1979 | Pine |
| 4,151,070 | A | 4/1979 | Allan et al. |
| 4,178,227 | A | 12/1979 | Metrailer et al. |
| 4,181,601 | A | 1/1980 | Sze |
| 4,192,735 | A | 3/1980 | Aldridge et al. |
| 4,196,072 | A | 4/1980 | Aldridge et al. |
| 4,226,742 | A | 10/1980 | Bearden, Jr. et al. |
| 4,252,634 | A | 2/1981 | Khulbe et al. |
| 4,285,804 | A | 8/1981 | Jacquin et al. |
| 4,298,454 | A | 11/1981 | Aldridge et al. |
| 4,305,808 | A | 12/1981 | Bowes et al. |
| 4,313,818 | A | 2/1982 | Aldridge et al. |
| 4,325,802 | A | 4/1982 | Porter et al. |
| 4,338,183 | A | 7/1982 | Gatsis |
| 4,352,729 | A | 10/1982 | Jacquin et al. |
| 4,370,221 | A | 1/1983 | Patmore et al. |
| 4,389,301 | A | 6/1983 | Dahlberg et al. |
| 4,411,768 | A | 10/1983 | Unger et al. |

(Continued)

FOREIGN PATENT DOCUMENTS

| | | |
|---|---|---|
| CA | 2004882 | 6/1991 |
| CA | 2088402 | 7/1994 |

(Continued)

OTHER PUBLICATIONS

U.S. Appl. No. 13/116,195, filed May 26, 2011, Lott et al.
U.S. Appl. No. 13/113,722, filed May 23, 2011, Harris et al.
U.S. Appl. No. 13/561,479, filed Jul. 30, 2012, Harris et al.
U.S. Appl. No. 13/866,220, filed Apr. 19, 2013, Lott et al.
U.S. Appl. No. 13/865,726, filed Apr. 18, 2013, Lott et al.
U.S. Appl. No. 14/095,698, filed Dec. 3, 2013, Lott et al.
Database CA [online] Chemical Abstracts Service retrieved from STN Database accession No. 1991.42412.
U.S. Appl. No. 11/968,934, dated Jul. 12, 2011, Office Action.
U.S. Appl. No. 11/117,262, dated Feb. 4, 2008, Office Action.
U.S. Appl. No. 11/117,262, dated Jul. 17, 2008, Office Action.
U.S. Appl. No. 11/117,262, dated Dec. 5, 2008, Office Action.
U.S. Appl. No. 11/117,262, dated Apr. 30, 2009, Notice of Allowance.

(Continued)

*Primary Examiner* — Randy Boyer
(74) *Attorney, Agent, or Firm* — Workman Nydegger

(57) ABSTRACT

Methods and systems for hydrocracking a heavy oil feedstock include using a colloidal or molecular catalyst (e.g., molybdenum sulfide) and provide for concentration of the colloidal or molecular catalyst within the lower quality materials requiring additional hydrocracking in one or more downstream reactors. In addition to increased catalyst concentration, the inventive systems and methods provide increased reactor throughput, increased reaction rate, and of course higher conversion of asphaltenes and lower quality materials. Increased conversion levels of asphaltenes and lower quality materials also reduces equipment fouling, enables the reactor to process a wider range of lower quality feedstocks, and can lead to more efficient use of a supported catalyst if used in combination with the colloidal or molecular catalyst.

25 Claims, 8 Drawing Sheets

(56) References Cited

U.S. PATENT DOCUMENTS 4,420,008 A 12/1983 Shu
4,422,927 A 12/1983 Kowalczyk et al.
4,422,960 A 12/1983 Shiroto et al.
4,427,532 A 1/1984 Varghese
4,430,207 A 2/1984 Kukes
4,435,314 A 3/1984 van de Leemput et al.
4,452,265 A 6/1984 Lönnebring
4,454,023 A 6/1984 Lutz
4,455,218 A 6/1984 Dymock et al.
4,465,630 A 8/1984 Akashi et al.
4,467,049 A 8/1984 Yoshii et al.
4,485,004 A 11/1984 Fisher et al.
4,485,008 A 11/1984 Maa et al.
4,508,616 A 4/1985 Larrauri et al.
4,513,098 A 4/1985 Tsao
4,551,230 A 11/1985 Kukes et al.
4,557,823 A 12/1985 Kukes et al.
4,557,824 A 12/1985 Kukes et al.
4,561,964 A 12/1985 Singhal et al.
4,564,441 A 1/1986 Kukes et al.
4,567,156 A 1/1986 Bearden, Jr. et al.
4,568,657 A 2/1986 Sepulveda et al.
4,578,181 A 3/1986 Derouane et al.
4,579,646 A 4/1986 Grosboll et al.
4,581,344 A 4/1986 Ledoux et al.
4,582,432 A 4/1986 Mehta
4,585,545 A 4/1986 Yancey, Jr. et al.
4,590,172 A 5/1986 Isaacs
4,592,827 A 6/1986 Galiasso et al.
4,592,830 A 6/1986 Howell et al.
4,606,809 A 8/1986 Garg
4,608,152 A 8/1986 Howell et al.
4,613,427 A 9/1986 Sepulveda et al.
4,626,340 A 12/1986 Galiasso et al.
4,633,001 A 12/1986 Cells
4,652,311 A 3/1987 Gulla et al.
4,652,647 A 3/1987 Schlosberg et al.
4,674,885 A 6/1987 Erwin et al.
4,676,886 A 6/1987 Rahbe et al.
4,678,557 A 7/1987 Rodriguez et al.
4,693,991 A 9/1987 Bjornson et al.
4,695,369 A 9/1987 Gart et al.
4,701,435 A 10/1987 Garcia et al.
4,707,245 A 11/1987 Baldasarri et al.
4,707,246 A 11/1987 Gardner et al.
4,710,486 A 12/1987 Lopez et al.
4,713,167 A 12/1987 Reno et al.
4,716,142 A 12/1987 Laine et al.
4,724,069 A 2/1988 Aldag, Jr. et al.
4,734,186 A 3/1988 Parrott et al.
4,740,295 A 4/1988 Bearden, Jr. et al.
4,746,419 A 5/1988 Peck et al.
4,762,607 A 8/1988 Aldridge et al.
4,762,812 A 8/1988 Lopez et al.
4,762,814 A 8/1988 Parrott et al.
4,764,266 A 8/1988 Chen et al.
4,765,882 A 8/1988 Aldridge et al.
4,770,764 A 9/1988 Ohtake et al.
4,772,378 A 9/1988 Miyauchi et al.
4,802,972 A 2/1989 Kukes et al.
4,808,007 A 2/1989 King
4,812,228 A 3/1989 Angevine et al.
4,824,611 A 4/1989 Cells
4,824,821 A 4/1989 Lopez et al.
4,834,865 A 5/1989 Kukes et al.
4,837,193 A 6/1989 Akizuki et al.
4,851,107 A 7/1989 Kretschmar et al.
4,851,109 A 7/1989 Chen et al.
4,857,496 A 8/1989 Lopez et al.
4,863,887 A 9/1989 Ohtake et al.
4,959,140 A 9/1990 Kukes et al.
4,963,247 A 10/1990 Belinko et al.
4,970,190 A 11/1990 Lopez et al.
4,983,273 A 1/1991 Kennedy et al.
4,983,558 A 1/1991 Born et al.
5,013,427 A 5/1991 Mosby et al.
5,017,535 A 5/1991 Schoonhoven et al.
5,017,712 A 5/1991 Usui et al.
5,038,392 A 8/1991 Morris et al.
5,039,392 A 8/1991 Bearden, Jr. et al.
5,055,174 A 10/1991 Howell et al.
5,094,991 A 3/1992 Lopez et al.
5,108,581 A 4/1992 Aldridge et al.
5,114,900 A 5/1992 King
5,134,108 A 7/1992 Thakur et al.
5,154,818 A 10/1992 Harandi et al.
5,162,282 A 11/1992 Lopez et al.
5,164,075 A 11/1992 Lopez
5,166,118 A 11/1992 Kretschmar et al.
5,171,916 A 12/1992 Le et al.
5,178,749 A 1/1993 Lopez et al.
5,191,131 A 3/1993 Takahata et al.
5,254,240 A 10/1993 Galiasso et al.
5,281,328 A 1/1994 Degnan, Jr. et al.
5,320,500 A 6/1994 Cholet
5,332,709 A 7/1994 Nappier et al.
5,358,634 A 10/1994 Rankel
5,364,524 A 11/1994 Partridge et al.
5,372,705 A 12/1994 Bhattacharya et al.
5,374,348 A 12/1994 Sears et al.
5,409,595 A 4/1995 Harandi et al.
5,435,908 A 7/1995 Nelson et al.
5,452,954 A 9/1995 Handke et al.
5,460,714 A 10/1995 Fixari et al.
5,474,977 A 12/1995 Gatsis
5,578,197 A 11/1996 Cyr et al.
5,597,236 A 1/1997 Fasano
5,622,616 A 4/1997 Porter et al.
5,865,537 A 2/1999 Streiff et al.
5,866,501 A 2/1999 Pradhan et al.
5,868,923 A 2/1999 Porter et al.
5,871,638 A * 2/1999 Pradhan ..... C10G 65/10 208/422
5,913,324 A 6/1999 Signer
5,916,432 A 6/1999 McFarlane et al.
5,925,235 A 7/1999 Habib
5,932,090 A 8/1999 Marchionna et al.
5,935,419 A 8/1999 Khan et al.
5,954,945 A 9/1999 Cayton et al.
5,962,364 A 10/1999 Wilson, Jr. et al.
5,972,202 A 10/1999 Benham et al.
6,004,453 A 12/1999 Benham
6,059,957 A 5/2000 Khan et al.
6,068,758 A 5/2000 Strausz
6,086,749 A 7/2000 Kramer et al.
6,090,858 A 7/2000 El-Sayed
6,093,824 A 7/2000 Reichle et al.
6,136,179 A 10/2000 Sherwood, Jr. et al.
6,139,723 A * 10/2000 Pelrine ..... C10G 65/10 201/2.5
6,190,542 B1 * 2/2001 Comolli ..... B01J 23/745 208/413
6,214,195 B1 4/2001 Yadav et al.
6,217,746 B1 4/2001 Thakkar et al.
6,239,054 B1 5/2001 Shukis et al.
6,270,654 B1 8/2001 Colyar et al.
6,274,530 B1 8/2001 Cayton et al.
6,277,270 B1 8/2001 Morel et al.
6,342,224 B1 1/2002 Bruck et al.
6,379,532 B1 4/2002 Hoehn et al.
6,454,932 B1 9/2002 Baldassari et al.
6,455,594 B1 9/2002 Tsuji
6,462,095 B1 10/2002 Bonsel et al.
6,550,960 B2 4/2003 Catalfamo et al.
6,596,155 B1 7/2003 Gates et al.
6,660,157 B2 12/2003 Que et al.
6,686,308 B2 2/2004 Mao et al.
6,698,917 B2 3/2004 Etchells, III et al.
6,712,955 B1 3/2004 Hou et al.
6,783,661 B1 8/2004 Briot et al.
6,797,153 B1 9/2004 Fukuyama et al.
6,884,340 B1 4/2005 Bogdan
6,916,762 B2 7/2005 Shibuya et al.
7,011,807 B2 3/2006 Zhou et al.

(56) References Cited

U.S. PATENT DOCUMENTS

| | | | | |
|---|---|---|---|---|
| 7,090,767 | B2 | 8/2006 | Kaminsky et al. | |
| 7,285,698 | B2 | 10/2007 | Liu et al. | |
| 7,449,103 | B2 | 11/2008 | Lott et al. | |
| 7,517,446 | B2 | 4/2009 | Lott et al. | |
| 7,578,928 | B2 | 8/2009 | Lott et al. | |
| 7,815,870 | B2 | 10/2010 | Lott et al. | |
| 8,034,232 | B2 | 10/2011 | Lott et al. | |
| 8,309,041 | B2 | 11/2012 | Lott et al. | |
| 8,435,400 | B2 * | 5/2013 | Kou | C10G 47/02 208/112 |
| 2002/0179493 | A1 | 12/2002 | Etter | |
| 2003/0094400 | A1 | 5/2003 | Levy et al. | |
| 2003/0171207 | A1 | 9/2003 | Shih et al. | |
| 2004/0013601 | A1 | 1/2004 | Butz et al. | |
| 2004/0147618 | A1 | 7/2004 | Lee et al. | |
| 2005/0109674 | A1 | 5/2005 | Klein | |
| 2005/0241991 | A1 | 11/2005 | Lott et al. | |
| 2005/0241992 | A1 | 11/2005 | Lott et al. | |
| 2005/0241993 | A1 | 11/2005 | Lott et al. | |
| 2005/0258073 | A1 | 11/2005 | Oballa et al. | |
| 2005/0279670 | A1 | 12/2005 | Long et al. | |
| 2006/0060501 | A1 * | 3/2006 | Gauthier | C10G 49/02 208/108 |
| 2006/0079396 | A1 | 4/2006 | Saito | |
| 2006/0175229 | A1 | 8/2006 | Montanari et al. | |
| 2006/0201854 | A1 | 9/2006 | Lott et al. | |
| 2006/0224000 | A1 | 10/2006 | Papp et al. | |
| 2006/0254956 | A1 | 11/2006 | Khan | |
| 2006/0289340 | A1 | 12/2006 | Brownscombe et al. | |
| 2007/0012595 | A1 | 1/2007 | Brownscombe et al. | |
| 2007/0029228 | A1 | 2/2007 | Aoki et al. | |
| 2007/0108100 | A1 | 5/2007 | Satchell, Jr. | |
| 2007/0131587 | A1 | 6/2007 | Fukuyama et al. | |
| 2007/0138059 | A1 * | 6/2007 | Farshid | C10G 65/12 208/57 |
| 2007/0158236 | A1 | 7/2007 | Zhou et al. | |
| 2007/0158238 | A1 | 7/2007 | Wu et al. | |
| 2007/0158239 | A1 | 7/2007 | Satchell | |
| 2007/0163921 | A1 | 7/2007 | Keusenkothen et al. | |
| 2007/0175797 | A1 | 8/2007 | Iki et al. | |
| 2007/0209965 | A1 | 9/2007 | Duddy et al. | |
| 2009/0107881 | A1 * | 4/2009 | Lott et al. | 208/74 |
| 2009/0159505 | A1 | 6/2009 | Da Costa et al. | |
| 2009/0173666 | A1 | 7/2009 | Zhou et al. | |
| 2009/0310435 | A1 | 12/2009 | Lott et al. | |
| 2010/0065472 | A1 * | 3/2010 | Chabot | 208/57 |
| 2010/0122931 | A1 | 5/2010 | Zimmerman et al. | |
| 2010/0294701 | A1 | 11/2010 | Lott et al. | |
| 2011/0017637 | A1 | 1/2011 | Reynolds | |
| 2011/0017641 | A1 | 1/2011 | Gupta et al. | |
| 2013/0068858 | A1 | 3/2013 | Nuzzo et al. | |

FOREIGN PATENT DOCUMENTS

| | | |
|---|---|---|
| CA | 2579528 | 9/2007 |
| CN | 1295112 | 5/2001 |
| CN | 1966618 | 5/2007 |
| DE | 2324441 | 12/1973 |
| DE | 2315114 | 10/1974 |
| DE | 2421934 | 11/1974 |
| EP | 0199399 | 10/1986 |
| EP | 0546686 | 6/1993 |
| EP | 0559399 | 9/1993 |
| EP | 1043069 | 10/2000 |
| EP | 1753846 | 2/2007 |
| GB | 1047698 | 11/1966 |
| JP | SHO47-14205 | 10/1972 |
| JP | Sho 59-108091 | 6/1984 |
| JP | 60-044587 | 3/1985 |
| JP | Sho 62-39634 | 8/1987 |
| JP | 01-165692 | 6/1989 |
| JP | 2863858 | 2/1990 |
| JP | Hei 06-009966 | 1/1994 |
| JP | 6287574 | 10/1994 |
| JP | 06346064 | 12/1994 |
| JP | 07-062355 | 3/1995 |
| JP | Hei 07-062355 | 3/1995 |
| JP | Hei 7-90282 | 4/1995 |
| JP | 08-325580 | 12/1996 |
| WO | 9723582 | 7/1997 |
| WO | 9734967 | 9/1997 |
| WO | 00/75336 | 12/2000 |
| WO | 00/01408 | 1/2001 |
| WO | 01/41799 | 6/2001 |
| WO | 2005/104749 | 11/2005 |
| WO | 2006116913 | 11/2006 |
| WO | 2007/078622 | 7/2007 |
| WO | 2007/106783 | 9/2007 |
| WO | 2009-058785 | 5/2009 |

OTHER PUBLICATIONS

U.S. Appl. No. 11/117,262, dated Jun. 26, 2009, Notice of Allowance.
U.S. Appl. No. 11/117,202, dated Apr. 29, 2008, Office Action.
U.S. Appl. No. 11/117,202, dated Aug. 18, 2008, Notice of Allowance.
U.S. Appl. No. 11/117,203, dated Jul. 10, 2008, Office Action.
U.S. Appl. No. 11/117,203, dated Dec. 10, 2008, Notice of Allowance.
U.S. Appl. No. 12/547,278, dated Dec. 29, 2011, Office Action.
U.S. Appl. No. 12/547,278, dated Sep. 7, 2012, Office Action.
U.S. Appl. No. 11/932,201, dated Nov. 23, 2009, Office Action.
U.S. Appl. No. 11/932,201, dated May 13, 2010, Office Action.
U.S. Appl. No. 11/932,201, dated Apr. 21, 2011, Notice of Allowance.
U.S. Appl. No. 11/932,201, dated Jun. 8, 2011, Notice of Allowance.
U.S. Appl. No. 13/236,209, dated Sep. 19, 2011, Office Action.
U.S. Appl. No. 13/236,209, dated Jul. 11, 2012, Notice of Allowance.
U.S. Appl. No. 13/675,629, dated Feb. 7, 2013, Office Action.
U.S. Appl. No. 12/106,112, dated Jan. 26, 2010, Office Action.
U.S. Appl. No. 12/106,112, dated Jun. 22, 2010, Notice of Allowance.
U.S. Appl. No. 12/838,761, dated May 18, 2011, Office Action.
U.S. Appl. No. 12/838,761, dated Jul. 20, 2012, Office Action.
U.S. Appl. No. 12/838,761, dated Jan. 10, 2013, Notice of Allowance.
U.S. Appl. No. 13/116,195, dated Jan. 12, 2012, Office Action.
U.S. Appl. No. 13/116,195, dated Jul. 11, 2012, Notice of Allowance.
U.S. Appl. No. 13/113,722, dated Aug. 8, 2012, Office Action.
U.S. Appl. No. 13/113,722, dated Jan. 22, 2013, Notice of Allowance.
U.S. Appl. No. 13/866,220, dated Jun. 28, 2013, Office Action.
U.S. Appl. No. 13/866,220, dated Nov. 13, 2006, Notice of Allowance.
U.S. Appl. No. 13/675,629, dated Jun. 14, 2013, Notice of Allowance.
Seader, et al. Perry's Chemical Engineers' Handbook, 7th Ed., Section 13—Distillation, 1997, p. 13-25.
Aspen HydrocrackerTM: A simulation system for monitoring, planning and optimizing hydrocracking and hydrotreating units, www.aspentec.com/brochures/hydrocraker.pdf (2001).
Criterion: Hydrocracking Process Description on CRITERION/CEOLYST Hydrocracking Catalyst Applications, www.criterioncatalysts.com (2001).
"Hyvahl, Significantly Improved RFCC Performance or Low Sulfur Fuel Oils Via Residue Hydrotreatment", Axen IPF Group Technologies, pp. 1, 2 (Jan. 2003).
"OCR Moving Bed Technology for the Future", pp. 1-2 (at least as early as 2004).
Plain C. et al. "Options for Resid Conversion", Axens IFP Group Technologies, pp. 1-10 (at least as early as 2004).
Santori, R., et al. "Eni Slurry Technology: A Technology to Conver the Bottom of the Barrel to Transportation Fuels", 3rd Bottom of the Barrel Technology Conference & Exhibition ( Oct. 2004).

(56) References Cited

OTHER PUBLICATIONS

Office Action dated Mar. 18, 2010 cited in U.S. Appl. No. 11/374,369.
Office Action dated May 28, 2009 cited in U.S. Appl. No. 11/374,369.
Bianco et al., "Upgrading heavy oil using slurry processes", Nov. 30, 1995, pp. 35-43.
Lott et al., "(HC)3 Process—A Slurry Hydrocracking Technology Designed to Convert Bottoms of Heavy Oils", 7th Unitar International Conference of Heavy Crude and Tar Sands, Beijing, Oct. 27, 2007, 1-9.
Panariti et al., "Petroleum residue upgrading with dispersed catalysts Part1. Catalysts activity and sensitivity", Mar. 31, 2000, pp. 203-213.
Panariti et al., "Petroleum residue upgrading with dispersed catalysts Part2. Effect of operating conditions", Mar. 31, 2000, pp. 215-222.
Lewis, Hawley's Condensed Chemical Dictionary, 15th Ed, 2007, p. 321.
Office Action dated Nov. 26, 2010 cited in U.S. Appl. No. 12/838,761.
Papaioannou et al., "Alkali-Metal- and Alkaline-Earth-Promoted Catalysts from Coal Liquefaction Applicatoins", Energy & Fuels, vol. 4, No. 1, pp. 38-42 (1990).
Molecular Profile Report, Cobalt Benzoate, http://chemfinder.cambridgesoft.com/chembiofinder/forms/search/contentarea/chembiovizsearch.aspx?formgroupid=8&appname=chembiofinder&allowfullsearch=true&keeprecordcountsynchronized-flase&searchcriteriaid=47searchcriteriavalue=932-69-4&currentindex=0. Database Ca [online] Chemical Abstacts Service retrieved from STN Database accession No. 1991:42412.
Hydrocracking of Liaohe Vacuum Residue With Bimeta:, Shen et al., Preprints of Symposia-America Chemical society, Division of Fuel Chemistry (1998), 43(3), 481-485, Ocden: Psadfz, 1998, XP009117504.
Office Action dated Sep. 20, 2010, in U.S. Appl. No. 11/968,934.
Office Action dated Jan. 25, 2011 in U.S. Appl. No. 11/968,934.
Notice of Allowance dated Jan. 6, 2012 in U.S. Appl. No. 11/968,934.
U.S. Appl. No. 14/836,792, filed Aug. 26, 2015, Harris et al.
U.S. Appl. No. 11/374,369, dated Mar. 12, 2014, Office Action.
U.S. Appl. No. 12/547,278, dated Apr. 22, 2014, Office Action.
U.S. Appl. No. 11/374,369, dated Aug. 28, 2014, Office Action.
U.S. Appl. No. 12/547,278, dated Nov. 24, 2014, Final Office Action.
U.S. Appl. No. 13/865,726, dated May 12, 2015, Office Action.
U.S. Appl. No. 13/561,479, dated Aug. 11, 2015, Office Action.
U.S. Appl. No. 13/561,479, dated Nov. 4, 2015, Final Office Action.
U.S. Appl. No. 13/865,726, dated Jan. 11, 2016, Final Office Action.
U.S. Appl. No. 13/561,479, dated Apr. 27, 2016, Office Action.
U.S. Appl. No. 11/374,369, dated May 18, 2016, Office Action.

* cited by examiner

METHODS FOR INCREASING CATALYST CONCENTRATION IN HEAVY OIL AND/OR COAL RESID HYDROCRACKER

CROSS REFERENCE TO RELATED APPLICATION

None

BACKGROUND OF THE INVENTION

1. The Field of the Invention

The present invention is in the field of upgrading heavy hydrocarbon feedstocks, such as heavy oil and/or coal (e.g., coal liquefaction) into lower boiling, higher quality materials.

2. Related Technology

World demand for refined fossil fuels is ever-increasing and will eventually outstrip the supply of high quality crude oil. As the shortage of high quality crude oil increases there will be an increasing demand to find ways to better exploit lower quality feedstocks and extract fuel values from them.

Lower quality feedstocks are characterized as including relatively high quantities of hydrocarbons that have a boiling point of 524° C. (975° F.) or higher. They also contain relatively high concentrations of sulfur, nitrogen and/or metals. High boiling fractions typically have a high molecular weight and/or low hydrogen/carbon ratio, an example of which is a class of complex compounds collectively referred to as "asphaltenes". Asphaltenes are difficult to process and commonly cause fouling of conventional catalysts and hydroprocessing equipment.

Examples of lower quality feedstocks that contain relatively high concentrations of asphaltenes, sulfur, nitrogen and metals include heavy crude and oil sands bitumen, as well as bottom of the barrel and residuum left over from conventional refinery processes (collectively "heavy oil"). The terms "bottom of the barrel" and "residuum" (or "resid") typically refer to atmospheric tower bottoms, which have a boiling point of at least 343° C. (650° F.), or vacuum tower bottoms, which have an initial boiling point of at least 524° C. (975° F.). Resid from other separators, such as hot separators, may qualify as heavy oil. The terms "resid pitch" and "vacuum residue" are commonly used to refer to fractions that have an initial boiling point of 524° C. (975° F.) or greater.

Converting heavy oil into useful end products requires extensive processing, including reducing the quantity of heavy oil by converting it to lighter, lower boiling petroleum fractions, increasing the hydrogen-to-carbon ratio, and removing impurities such as metals, sulfur, nitrogen and high carbon forming compounds.

When used to process heavy oil, existing commercial catalytic hydrocracking processes can become fouled or rapidly undergo catalyst deactivation. The undesirable reactions and fouling involved in hydrocracking heavy oil greatly increases the catalyst and maintenance costs of processing heavy oils, making current catalysts less economical for hydroprocessing heavy oil.

One promising technology for hydroprocessing heavy oils uses a hydrocarbon-soluble molybdenum salt that decomposes in the heavy oil during hydroprocessing to form, in situ, a hydroprocessing catalyst, namely molybdenum sulfide. One such process is disclosed in U.S. Pat. No. 5,578,197 to Cyr et al., which is incorporated herein by reference. Once formed in situ, the molybdenum sulfide catalyst is highly effective at hydrocracking asphaltenes and other complicated hydrocarbons while preventing fouling and coking.

A significant problem with commercializing oil soluble molybdenum catalysts is the cost of the catalyst. Even small improvements in catalyst performance can have a significant benefit to the economics of the hydrocracking process due to the increase in output and/or the reduced use of the catalyst.

The performance of oil soluble molybdenum catalysts depends significantly on how well the catalyst precursor can be dispersed in the heavy oil and/or other heavy hydrocarbon (e.g., coal) feedstock and the concentration of the metal catalyst in the heavy hydrocarbon being cracked. It would be an improvement in the art to provide methods and systems that result in concentration of the metal catalyst within feed streams containing heavy hydrocarbon components requiring additional hydrocracking, which would minimize the overall quantity of catalyst used and improve the overall efficiency and conversion levels, all while minimizing processing costs.

SUMMARY OF THE PREFERRED EMBODIMENTS

The present invention relates to methods and systems for hydrocracking a heavy hydrocarbon (e.g., heavy oil and/or coal) feedstock using a colloidally or molecularly dispersed catalyst (e.g., molybdenum sulfide). The present systems and processes may be used to upgrade heavy oil feedstocks, coal feedstocks or mixtures of heavy oil and coal feedstocks. As such, the term "heavy oil" as used herein broadly includes coal, for example as used in a coal liquefaction system to upgrade the coal feedstock (and/or a mixture of liquid heavy oil and coal) into higher quality, lower boiling hydrocarbon materials.

The inventive methods and systems utilize two or more hydrocracking reactors and one or more interstage pressure differential separators. At least one of the interstage separators is interposed between two of the hydrocracking reactors. In the case where a method or system includes three or more hydrocracking reactors, there may be a single interstage separator interposed between two of the hydrocracking reactors, or there may be a first interstage separator interposed between a first pair of hydrocracking reactors a second interstage separator interposed between a second pair of hydrocracking reactors. It is also possible to include other separation apparatus, such as one or more distillation towers in addition to the at least one interstage separator.

The hydrocracking reactors decrease the quantity of asphaltenes and other higher boiling materials within the heavy oil in the presence of hydrogen and a suitable upgrading catalyst to yield an upgraded material having a higher quantity of lower boiling materials compared to the heavy oil initially fed to the hydrocracking reactors. At least two hydrocracking reactors in the disclosed methods and systems include a colloidal or molecular catalyst. An interstage pressure differential separator interposed between two hydrocracking reactors removes a higher quality, lower boiling vapor fraction from a lower quality, higher boiling liquid fraction. The interstage separator advantageously provides for increased concentration of the colloidally or molecularly dispersed catalyst within the remaining liquid fraction. In some cases, the quality of the liquid fraction removed from the interstage separator and introduced into the second hydrocracking reactor will be of even lower quality than the heavy oil feedstock introduced into the first hydrocracking reactor. Such materials may require increased hydrocracking capability of the reactor following the interstage separator, which may operate more efficiently and therefore benefit from an increased concentration of colloidally or molecularly dispersed catalyst.

Depending on the quality of the liquid fraction from the interstage separator and the amount and/or quality of residual colloidally or molecularly dispersed catalyst in the liquid fraction introduced in the downstream hydrocracking reactor, it may be desirable to provide additional colloidally or molecularly dispersed catalyst within the liquid fraction in the downstream reactor, such as by adding a colloidal or molecular catalyst to the hydrocracking reactor or catalyst precursor to the interstage separator or other location upstream from the downstream hydrocracking reactor.

By providing a higher concentration of colloidally or molecularly dispersed catalyst in one or more downstream hydrocracking reactors compared to the concentration of such catalyst in one or more upstream hydrocracking reactors, the inventive systems and methods provide increased system throughput, increased reaction rate, and higher conversion levels of asphaltenes and high boiling lower quality materials compared to methods and systems in which the amount of colloidal or molecular catalyst is not increased in one or downstream reactors. Increased conversion levels of asphaltenes and lower quality materials reduces equipment fouling, enables the reactor to process a wider range of lower quality feedstocks, and can optionally facilitate more efficient use of a supported catalyst if such catalyst is used in addition to the colloidal or molecular catalyst.

An exemplary method and system utilizes a first gas-liquid two or more phase hydrocracking reactor (e.g., a two-phase gas-liquid reactor) and at least a second gas-liquid two or more phase hydrocracking reactor arranged in series with the first gas-liquid two or more phase reactor. For simplicity, the gas-liquid two or more phase reactors are herein referred to as hydrocracking reactors and may optionally include a third (i.e., solid) phase comprising, for example, coal particles and/or a supported catalyst. Although it may be possible to operate the reactor systems with an ebullated bed or fixed bed of solid supported catalyst in addition to the colloidal or molecular catalyst, preferred systems may employ only the colloidal and/or molecular catalyst.

Each gas-liquid two-phase reactor operates at a respective pressure. An interstage pressure differential separator is disposed between first and second hydrocracking reactors. The interstage separator provides a pressure drop from the operating pressure of a first hydrocracking reactor (e.g., 2400 psig) down to a second, lower pressure (e.g., operating pressure of a second hydrocracking reactor, for example, 2000 psig). The pressure drop induced by the interstage separator allows the effluent from the first hydrocracking reactor to be separated into a lighter lower boiling fraction (which volatilizes) and a higher boiling bottoms liquid fraction.

Advantageously, the colloidally dispersed catalyst remains with the higher boiling bottoms liquid fraction during the phase separation, resulting in a catalyst concentration within the liquid fraction that is elevated as compared to the catalyst concentration within the overall effluent from the first hydrocracking reactor. In addition, the catalyst concentration within the liquid fraction removed from the interstage separator is greater than the catalyst concentration of the heavy oil in the first hydrocracking reactor. At least a portion of the higher boiling bottoms liquid fraction is then introduced into a second or downstream hydrocracking reactor.

The pressure drop achieved upon entering the interstage separator may typically range between about 100 psi and about 1000 psi. Preferably, the pressure drop is between about 200 psi and about 700 psi, and more preferably the pressure drop within the interstage separator is between about 300 and about 500 psi. Higher pressure drops result in a greater percentage of the first hydrocracking reactor effluent being volatilized and withdrawn with the lower boiling volatile gaseous vapor fraction. This, in turn, increases the efficiency of the second hydrocracking reactor by (1) increasing catalyst concentration; (2) reducing the volume of material being hydrocracked so that a smaller second reactor may be employed; (3) withdrawing lighter boiling fraction materials (e.g., $C_1$-$C_7$ hydrocarbons) which may otherwise tend to promote additional asphaltene and/or coke formation; and (4) increasing the concentration of materials in need of upgrading so that lighter and more valuable fractions are not further processed to reduce boiling point.

Additional fresh hydrogen gas is typically introduced into the second reactor under pressure along with the liquid effluent from the interstage separator. In some cases the operating pressure of the downstream reactor will be less than the operating pressure of the upstream reactor. In other cases, through the use of pressurizing apparatus and valves, the pressure within the second reactor may be higher than the pressure within the separator (e.g., it may be pressurized back up to the operating pressure of the first reactor).

The colloidal or molecular catalyst is advantageously concentrated within the higher boiling liquid fraction that is withdrawn out the bottom of the interstage pressure differential separator. For example, the concentration of colloidal or molecular catalyst within the higher boiling bottoms liquid fraction introduced into the second or downstream hydrocracking reactor may have a catalyst concentration that is at least about 10 percent higher than the concentration of the catalyst present within the effluent from the first or upstream hydrocracking reactor, as a result of the lighter fraction (which is substantially free of catalyst) being separated and drawn off as vapor from the interstage separator. Preferably, the catalyst concentration within the higher boiling bottoms liquid fraction introduced into the second or downstream hydrocracking reactor is at least about 25 percent higher than the concentration of the catalyst present within the effluent from the first or upstream hydrocracking reactor, more preferably at least about 30 percent higher, and most preferably at least about 35 percent higher.

Typically, the concentration of catalyst entering the second reactor may range between about 10 percent and about 100 percent higher than the catalyst concentration within the first reactor, preferably between about 15 percent and about 75 percent higher, more preferably between about 20 percent and about 50 percent higher, and most preferably between about 25 percent and about 40 percent higher. In one embodiment, about 10 percent to about 50 percent of the material can be typically flashed off within the interstage separator, preferably between about 15 percent and about 40, more preferably between about 15 percent and about 35 percent, and most preferably between about 20 percent and about 30 percent.

Alternatively, at least a portion of the foregoing increase in catalyst concentration can be obtained by providing additional colloidal or molecular catalyst as discussed herein in addition to whatever colloidal or molecular catalyst remains in the higher boiling liquid fraction after removing the lower boiling vapor fraction (e.g., using an interstage separator). The additional colloidal or molecular catalyst added to the hydroprocessing system in order to further increase the concentration of colloidal or molecular catalyst within a second or downstream reactor may account for at least about 5%, 10%, 20%, 35%, 50% or 75% of the increase in concentration of colloidal or molecular catalyst within a second or downstream reactor compared to the first or upstream reactor.

In one exemplary system and method, no recycle of the higher boiling bottoms liquid fraction from the interstage separator back into the first hydrocracking reactor (e.g., as a source of feedstock and/or catalyst) is necessary, as the present system provides for higher boiling effluent material remaining from the first reactor to be sent to the second reactor. In other words, all of the liquid fraction from the interstage separator may be introduced into the second hydrocracking reactor. Nevertheless, it is within the scope of the invention to recycle a portion of the liquid fraction from the interstage separator back to the first or upstream hydrocracking reactor and sending the remaining portion to the second or downstream hydrocracking reactor.

The system may further include a third hydrocracking reactor and a second interstage separator disposed between the second hydrocracking reactor and the third hydrocracking reactor. Such a second interstage separator performs another separation between lighter lower boiling volatile gaseous vapor materials which are drawn off and a second higher boiling bottoms liquid fraction in which the colloidally and/or molecularly dispersed catalyst is even more concentrated than in the second hydrocracking reactor. Additional gas-liquid two or more phase (or other type) reactors and interstage pressure differential or other type separators (e.g., one or more distillation towers) may also be provided, although such additional equipment may be unnecessary, as the inventors have found that systems that include two hydrocracking reactors and a single interstage separator disposed therebetween can produce very high conversion levels of asphaltenes (e.g., 60 to 80 percent or more). Of course, overall conversion is dependent on catalyst concentration, reactor temperature, reactor pressure, hydrogen concentration, space velocity, and number of reactors, as well as other variables. Those skilled in the art will appreciate that reactor systems according to the present invention may be designed and configured to maximize and/or minimize any desired variable within given constraints relative to the remaining variables.

An alternative exemplary system includes a first gas-liquid two or more phase hydrocracking reactor and at least a second gas-liquid two or more phase hydrocracking reactor arranged in series with the first or upstream reactor. Lower boiling volatile gaseous vapor effluent from the first or upstream reactor is withdrawn from the top of the reactor separately from the remaining effluent (which principally includes higher boiling liquid effluent) from the reactor. In other words, the effluent is separated into two phases, but without a formal interstage separation unit. Advantageously, the colloidal or molecular dispersed catalyst remains with the higher boiling liquid effluent fraction, resulting in a catalyst concentration within this stream that is elevated as compared to the catalyst concentration within the heavy oil feedstock introduced into the first or upstream hydrocracking reactor.

The higher boiling liquid fraction stream from the first or upstream reactor is then introduced into the second or downstream reactor to further upgrade this material. A lower boiling volatile gaseous vapor effluent from the second reactor is fed along with the lower boiling gaseous vapor fraction withdrawn from the first reactor is sent downstream for further processing and recovery of valuable streams.

In each embodiment, the inventive systems and methods result in concentration of the catalyst within the higher boiling liquid fraction requiring additional hydrocracking, either as a result of separating a lower boiling fraction from a higher boiling fraction that includes colloidal or molecular catalyst and/or providing additional colloidal or molecular catalyst to downstream reactor(s). The increased catalyst concentration provides increased reactor throughput, increased reaction rate, and of course higher conversion of asphaltenes and lower quality materials. Increased conversion levels of asphaltenes and lower quality materials also reduce equipment fouling, enable the hydrocracking reactors to process a wider range of lower quality feedstocks, and can lead to more efficient use of a supported catalyst if used in combination with the colloidal or molecular catalyst (e.g., in an example where the hydrocracking reactors comprise three-phase reactors). In addition, withdrawal of at least some of the lower boiling volatile gaseous vapor fraction before introducing the remaining higher boiling effluent into the second reactor reduces the volume of material to be reacted (i.e., the second reactor can be smaller than would otherwise be required, resulting in a cost savings).

By removing lower boiling vapor components from the products of first reactor, the liquid throughput through the second reactor can be significantly increased (if reactor diameter remains constant). Alternatively, for a given reactor diameter, the reduction in vapor flow rate results in reduced gas hold up within the second reactor so that the reactor can be shorter to achieve a desired conversion level, or with a longer reactor, higher conversion can be achieved. In other words, there are vapor products generated (e.g., including, but not limited to $C_1$-$C_4$ light hydrocarbons) within the reactor that simply take up space. Removal of these components lowers gas hold up, which may be thought of as effectively increasing the size of the reactor.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF THE PREFERRED EMBODIMENTS

I. Introduction

Figure 1:
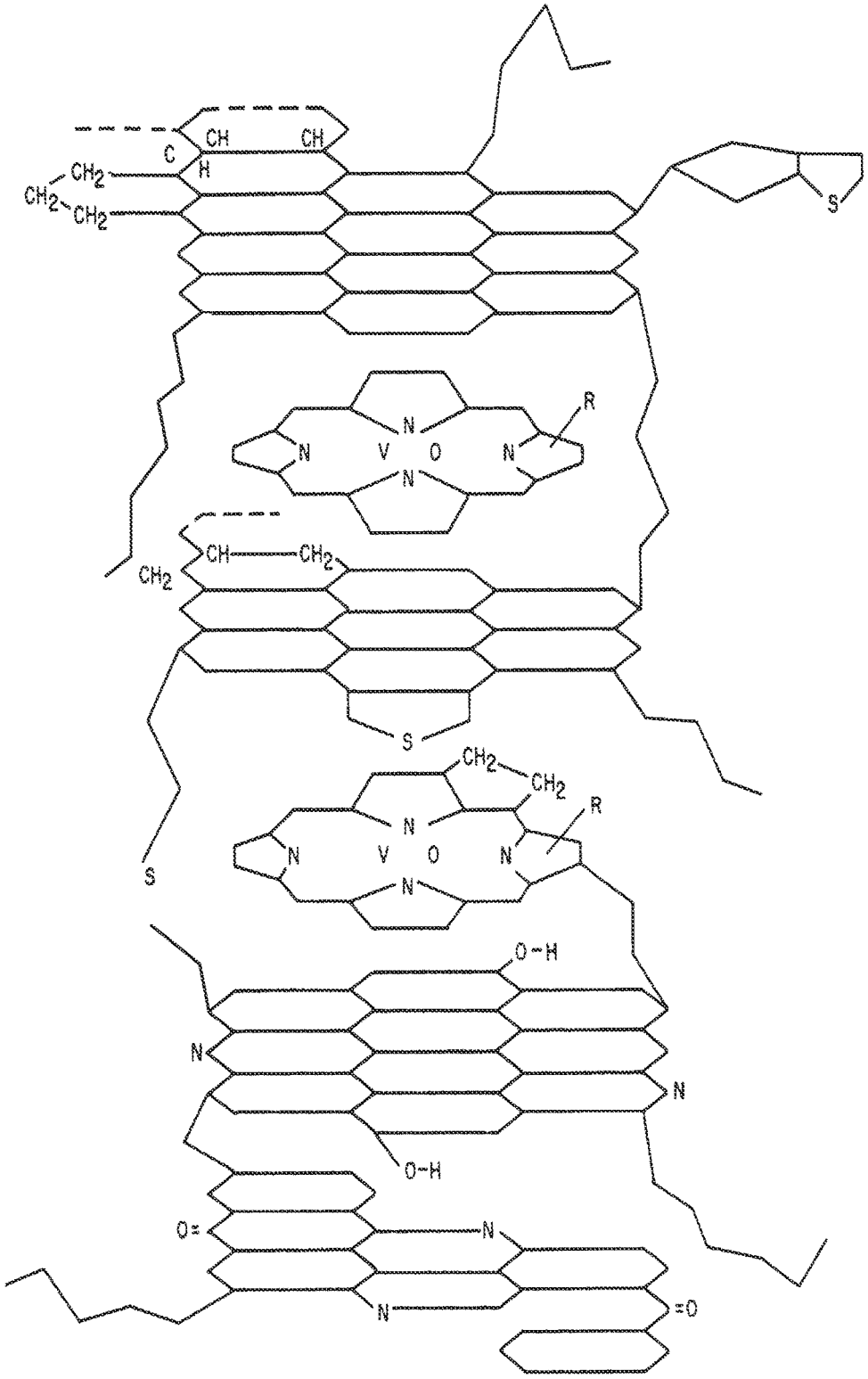
FIG. 1 depicts a hypothetical chemical structure for an asphaltene molecule.

The present invention relates to methods and systems for hydrocracking a heavy oil feedstock using a colloidal or molecular catalyst. The inventive methods and systems advantageously provide for increased concentration of the colloidal or molecular catalyst within the lower quality materials needing additional hydrocracking in order to form higher value materials without expensive and complicated separation steps to remove the catalyst from product streams containing the desired product materials, which may be prohibitively expensive. In addition to increased catalyst concentration, the inventive systems and methods reduce the volume of material introduced into downstream reactors and other equipment, provide increased reactor throughput, increased reaction rate, and higher conversion of asphaltenes and lower quality materials. Increased conversion levels of asphaltenes and lower quality materials also reduces equipment fouling, enables the reactor to process a wider range of lower quality feedstocks, and can lead to more efficient use of a supported catalyst if used in combination with the colloidal or molecular catalyst.

In one embodiment, the methods and systems employ two or more gas-liquid two or more phase hydrocracking reactors in series and an interstage pressure differential separator arranged between the reactors. The interstage separator operates by subjecting the effluent from the first hydrocracking reactor to a pressure drop (e.g., across a valve as the material enters the separator), causing a phase separation between a gaseous and/or volatile lower boiling fraction and a higher boiling liquid fraction of the effluent. Advantageously, the catalyst remains in the liquid fraction, substantially increasing the catalyst concentration within this fraction. The liquid fraction is then introduced into the second gas-liquid two or more phase hydrocracking reactor. Such an increase in catalyst concentration, as well as the reduction in volume of material (as a result of the lower boiling volatile gaseous/vapor fraction being removed) provides increased conversion levels at overall reduced cost. Furthermore, removal of low boiling point components from the stream prior to introduction into the second reactor results in reduced gas hold up (i.e., gases occupy less of the reactor volume, and the partial pressure and/or fraction of hydrogen gas as a fraction of total gas volume is increased).

An alternative exemplary system also includes at least two gas-liquid two or more phase hydrocracking reactors arranged in series. Lower boiling volatile gaseous vapor effluent from the first reactor is withdrawn separately from the higher boiling liquid effluent from the first reactor (i.e., the effluent is separated into two phases, but without a formal separation unit). Advantageously, the colloidally and/or molecularly dispersed catalyst remains with the higher boiling liquid effluent fraction, resulting in a colloidal or molecular catalyst concentration within this stream that is elevated as compared to the colloidal or molecular catalyst concentration within the heavy oil feedstock processed within the first hydrocracking reactor. The higher boiling liquid fraction is then introduced into the second hydrocracking reactor to further upgrade this material. A lower boiling reactor effluent from the second reactor is fed along with the lower boiling gaseous vapor fraction withdrawn from the first reactor downstream within the hydroprocessing system for further treatment and/or processing.

Depending on the quality of the liquid fraction from the upstream reactor and/or interstage separator and the amount and/or quality of residual colloidal or molecular catalyst in the liquid fraction introduced in the downstream hydrocracking reactor, it may be desirable to provide additional colloidal or molecular catalyst within the downstream reactor, such as by adding a colloidal or molecular catalyst to the hydrocracking reactor or catalyst precursor to the interstage separator or other location upstream from the downstream hydrocracking reactor.

In each embodiment the inventive systems and methods provide increased reactor throughput, increased reaction rate, and higher conversion of asphaltenes and lower quality materials. Increased conversion levels of asphaltenes and lower quality materials to higher quality materials also reduces equipment fouling (e.g., due to coke and/or asphaltene deposition), enables the gas-liquid two or more phase reactor system to process a wider range of lower quality feedstocks, and can lead to more efficient use of a supported catalyst if used in combination with the colloidal or molecular catalyst.

II. Definitions

The terms "colloidal catalyst" and "colloidally-dispersed catalyst" shall refer to catalyst particles having a particle size that is colloidal in size, e.g., less than 500 nm in diameter, preferably less than about 100 nm in diameter, more preferably less than about 10 nm in diameter, even more preferably less than about 5 nm in diameter, and most preferably less than about 1 nm in diameter. The term "colloidal catalyst" includes, but is not limited to, molecular or molecularly-dispersed catalyst compounds.

The terms "molecular catalyst" and "molecularly-dispersed catalyst" shall refer to catalyst compounds that are essentially "dissolved" or completely dissociated from other catalyst compounds or molecules in a heavy oil hydrocarbon feedstock, non-volatile liquid fraction, bottoms fraction, resid, or other feedstock or product in which the catalyst may be found. It shall also refer to very small catalyst particles that only contain a few catalyst molecules joined together (e.g., 15 molecules or less).

The terms "blended feedstock composition" and "conditioned feedstock composition" shall refer to a heavy oil feedstock into which an oil soluble catalyst precursor composition has been combined and mixed sufficiently so that, upon decomposition of the catalyst precursor and formation of the catalyst, the catalyst will comprise a colloidal and/or molecular catalyst dispersed within the feedstock.

The term "heavy oil feedstock" shall refer to heavy crude, oils sands bitumen, bottom of the barrel and resid left over from refinery processes (e.g., visbreaker bottoms), and any other lower quality material that contains a substantial quantity of high boiling hydrocarbon fractions (e.g., that boil at or above 343° C. (650° F.), more particularly at or above about 524° C. (975° F.)), and/or that include a significant quantity of asphaltenes that can deactivate a solid supported catalyst and/or cause or result in the formation of coke precursors and sediment. As used herein, the term may also broadly include coal, for example as used in a coal liquefaction system to upgrade the coal feedstock into higher quality, lower boiling hydrocarbon materials. Examples of heavy oil feedstocks include, but are not limited to, Lloydminster heavy oil, Cold Lake bitumen, Athabasca bitumen, atmospheric tower bottoms, vacuum tower bottoms, residuum (or "resid"), resid pitch, vacuum residue, and higher-boiling liquid fractions that remain after subjecting crude oil, bitumen from tar sands, liquefied coal, or coal tar feedstocks to distillation, hot separation, and the like and that contain higher boiling fractions and/or asphaltenes.

The term "asphaltene" shall refer to the fraction of a heavy oil feedstock that is typically insoluble in paraffinic solvents such as propane, butane, pentane, hexane, and heptane and that includes sheets of condensed ring compounds held together by hetero atoms such as sulfur, nitrogen, oxygen and metals. Asphaltenes broadly include a wide range of complex compounds having anywhere from 80 to 160,000 carbon atoms, with predominating molecular weights, as determined by solution techniques, in the 5000 to 10,000 range. About 80-90% of the metals in the crude oil are contained in the asphaltene fraction which, together with a higher concentration of non-metallic hetero atoms, renders the asphaltene molecules more hydrophilic and less hydrophobic than other hydrocarbons in crude. A hypothetical asphaltene molecule structure developed by A. G. Bridge and co-workers at Chevron is depicted in FIG. 1.

The term "hydrocracking" shall refer to a process whose primary purpose is to reduce the boiling range and molecular weight of constituents within a heavy oil feedstock and in which a substantial portion of the feedstock is converted into products with boiling ranges and molecular weights that are lower than that of the original feedstock. Hydrocracking generally involves fragmentation of larger hydrocarbon molecules into smaller molecular fragments having a fewer number of carbon atoms and a higher hydrogen-to-carbon ratio. The mechanism by which hydrocracking occurs typically involves the formation of hydrocarbon free radicals during fragmentation followed by capping of the free radical ends or moieties with hydrogen. The hydrogen atoms or radicals that react with hydrocarbon free radicals during hydrocracking are generated at or by active catalyst sites.

The term "hydrotreating" shall refer to a more mild operation whose primary purpose is to remove impurities such as sulfur, nitrogen, oxygen, halides, and trace metals from the feedstock and saturate olefins and/or stabilize hydrocarbon free radicals by reacting them with hydrogen rather than allowing them to react with themselves. The primary purpose is not to change the boiling range of the feedstock. Hydrotreating is most often carried out using a fixed bed reactor, although other hydroprocessing reactors can also be used for hydrotreating, an example of which is an ebullated bed hydrotreater.

Of course, "hydrocracking" may also involve the removal of sulfur and nitrogen from a feedstock as well as olefin saturation and other reactions typically associated with "hydrotreating". The term "hydroprocessing" shall broadly refer to both "hydrocracking" and "hydrotreating" processes, which define opposite ends of a spectrum, and everything in between along the spectrum.

The terms "solid supported catalyst", "porous supported catalyst" and "supported catalyst" shall refer to catalysts that are typically used in conventional ebullated bed and fixed bed hydroprocessing systems, including catalysts designed primarily for hydrocracking or hydrodemetallization and catalysts designed primarily for hydrotreating. Such catalysts typically comprise (i) a catalyst support having a large surface area and numerous interconnected channels or pores of uneven diameter and (ii) fine particles of an active catalyst such as sulfides of cobalt, nickel, tungsten, and molybdenum dispersed within the pores. For example a heavy oil hydrocracking catalyst manufactured by Criterion Catalyst, Criterion 317 trilube catalyst, has a bi-modal pore size distribution, with 80% of the pores ranging between 30 to 300 Angstroms with a peak at 100 Angstroms and 20% of the pores ranging between 1000 to 7000 Angstroms with a peak at 4000 Angstroms. The pores for the solid catalyst support are of limited size due to the need for the supported catalyst to maintain mechanical integrity to prevent excessive breakdown and formation of excessive fines in the reactor. Supported catalysts are commonly produced as cylindrical pellets or spherical solids.

The term "hydrocracking reactor" shall refer to any vessel in which hydrocracking (i.e., reducing the boiling range) of a feedstock in the presence of hydrogen and a hydrocracking catalyst is the primary purpose. Hydrocracking reactors are characterized as having an input port into which a heavy oil feedstock and hydrogen can be introduced, an output port from which an upgraded feedstock or material can be withdrawn, and sufficient thermal energy so as to form hydrocarbon free radicals in order to cause fragmentation of larger hydrocarbon molecules into smaller molecules. Methods and systems of the present invention employ a series of at least two gas-liquid two or more phase hydrocracking reactors (e.g., a two-phase, gas-liquid system or a three-phase gas-liquid-solid system). In each case, the reactor includes at least a gas phase and a liquid phase. Although preferred embodiments of the invention may include at least two gas-liquid hydrocracking reactors that do not include any solid supported catalyst phase, in alternative embodiments one or both of the at least two hydrocracking reactors may comprise three-phase gas-liquid-solid hydrocracking reactors comprising a solid supported catalyst (e.g., ebullated bed, fixed bed, or moving bed). Other three-phase embodiments may include coal particles as a solid phase, which may or may not include a solid supported catalyst phase. Examples of three-phase hydrocracking reactors include, but are not limited to, ebullated bed reactors (i.e., a gas-liquid-ebullated solid bed system), and fixed bed reactors (i.e., a three-phase system that includes a liquid feed trickling downward over a fixed bed of solid supported catalyst with hydrogen gas typically flowing cocurrently, but possibly countercurrently in some cases). Another embodiment includes a conventional slurry phase reactor with relatively large (e.g., 1 mm in diameter or larger) solid catalyst particles that can migrate with the effluent from one reactor to another.

The term "hydrocracking temperature" shall refer to a minimum temperature required to effect significant hydrocracking of a heavy oil feedstock. In general, hydrocracking temperatures will preferably fall within a range of about 410° C. (770° F.) to about 460° C. (860° F.), more preferably in a range of about 420° C. (788° F.) to about 450° C. (842° F.), and most preferably in a range of about 430° C. (806° F.) to about 445° C. (833° F.). It will be appreciated that the temperature required to effect hydrocracking may vary depending on the properties and chemical make up of the heavy oil feedstock. Severity of hydrocracking may also be imparted by varying the space velocity of the feedstock, i.e., the residence time of feedstock in the reactor, while maintaining the reactor at a fixed temperature. Milder reactor temperature and longer feedstock space velocity are typically required for heavy oil feedstock with high reactivity and/or high concentration of asphaltenes.

The terms "gas-liquid two or more phase hydrocracking reactor" "hydrocracking reactor" and "gas-liquid two-phase hydrocracking reactor" shall refer to a hydroprocessing reactor that includes a continuous liquid phase and a gaseous dispersed phase within the liquid phase. The liquid phase typically comprises a hydrocarbon feedstock that may contain a low concentration of a colloidal catalyst or molecular-sized catalyst, and the gaseous phase typically comprises hydrogen gas, hydrogen sulfide, and vaporized low boiling point hydrocarbon products. The term "gas-liquid-solid, 3-phase hydrocracking reactor" or "gas-liquid-solid, 3-phase slurry hydrocracking reactor" may be used when a solid catalyst and/or solid coal particles are included as a solid phase along with liquid and gas. The gas may contain hydrogen, hydrogen sulfide and vaporized low boiling hydrocarbon products. The terms "gas-liquid two or more phase hydrocracking reactor" "hydrocracking reactor" and "gas-liquid two-phase hydrocracking reactor" shall broadly refer to both type of reactors (e.g., those with a gas phase and a liquid phase including a colloidal or molecular catalyst, and which may optionally include solid coal particles and/or employ a micron-sized or larger solid/particulate catalyst in addition to the colloidal or molecular catalyst), although preferred embodiments may be substantially free of any solid phase. An exemplary gas-liquid two phase reactor is disclosed in U.S. Pat. No. 6,960,325 entitled "APPARATUS FOR HYDROCRACKING AND/OR HYDROGENATING FOSSIL FUELS", the disclosure of which is incorporated herein by specific reference.

The terms "upgrade", "upgrading" and "upgraded", when used to describe a feedstock that is being or has been subjected to hydroprocessing, or a resulting material or product, shall refer to one or more of a reduction in the molecular weight of the feedstock, a reduction in the boiling point range of the feedstock, a reduction in the concentration of asphaltenes, a reduction in the concentration of hydrocarbon free radicals, and/or a reduction in the quantity of impurities, such as sulfur, nitrogen, oxygen, halides, and metals.

The colloidal and/or molecular catalyst is typically formed in situ within the heavy oil feedstock prior to, or upon commencing, hydroprocessing of the feedstock. The oil soluble catalyst precursor comprises an organo-metallic compound or complex, which is advantageously blended with and thoroughly dispersed within the heavy oil feedstock in order to achieve a very high dispersion of the catalyst precursor within the feedstock prior to heating and decomposition of the precursor and formation of the final active catalyst. An exemplary catalyst precursor is a molybdenum 2-ethylhexanoate complex containing approximately 15% by weight molybdenum. This precursor can be converted into molybdenum sulfide upon heating and decomposing the catalyst precursor within a heavy oil feedstock that includes sufficient sulfides to form an active metal sulfide catalyst in situ within the heavy oil feedstock.

In order to ensure thorough mixing of the catalyst precursor within the heavy oil feedstock, the catalyst precursor can be mixed into the heavy oil feedstock through a multi-step blending process. According to one such process, the oil soluble catalyst precursor is pre-blended with a hydrocarbon oil diluent (e.g., vacuum gas oil, decant oil, cycle oil, or light gas oil) to create a diluted catalyst precursor mixture, which is thereafter blended with at least a portion of the heavy oil feedstock so as to form a highly dispersed mixture of the catalyst precursor within the heavy oil feedstock. This mixture is blended with any remaining heavy oil feedstock in such a way so as to result in the catalyst precursor being substantially homogeneously dispersed down to the molecular level within the conditioned heavy oil feedstock. The conditioned feedstock composition may then be heated to decompose the catalyst precursor, forming a colloidal or molecular catalyst within the heavy oil feedstock.

III. Exemplary HydroProcessing Systems and Methods

Figure 2A:
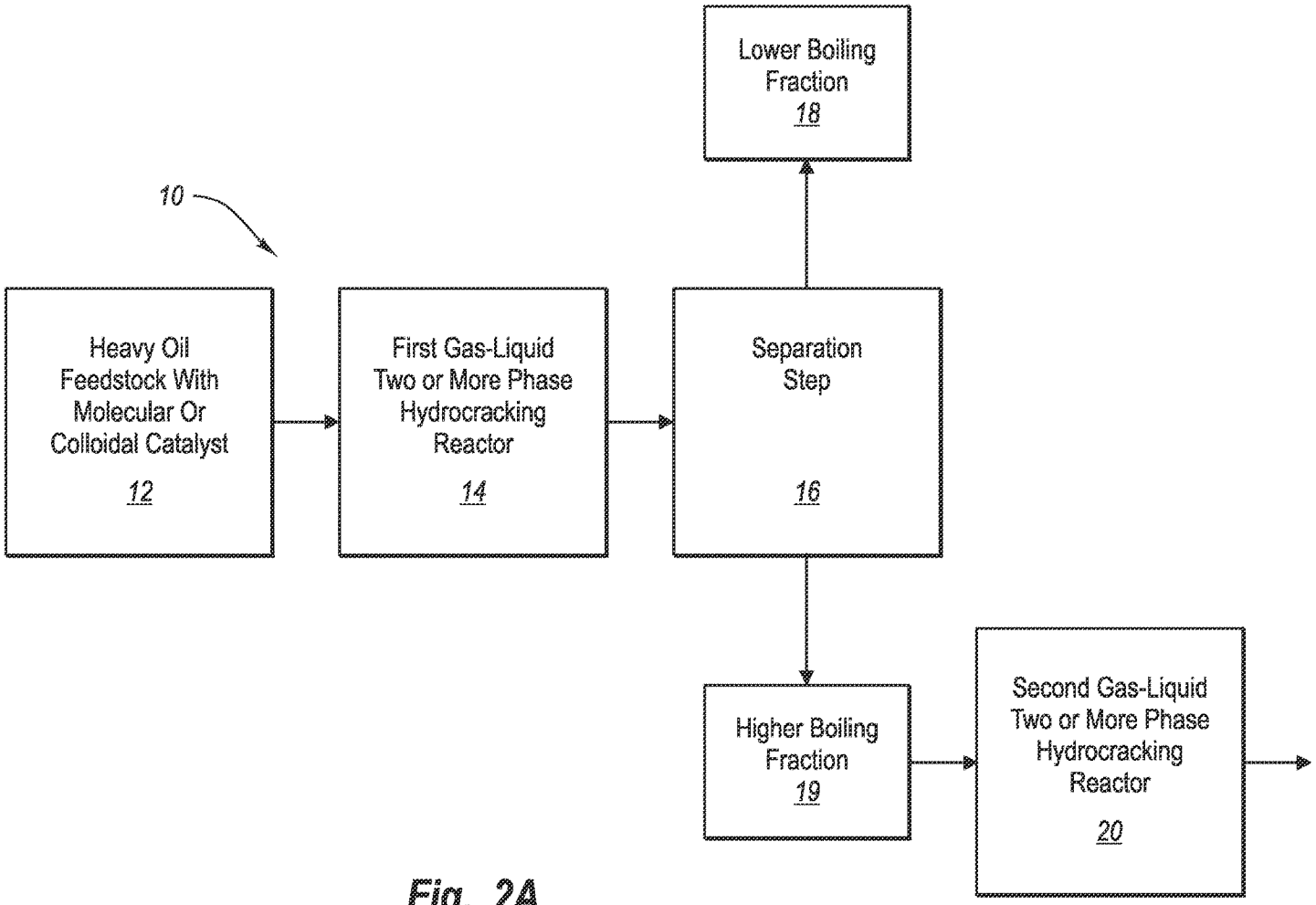
FIG. 2A is a block diagram that schematically illustrates an exemplary hydrocracking system according to the invention for upgrading a heavy oil feedstock in which the concentration of colloidal or molecular catalyst increases in a remaining higher boiling liquid fraction by removing a lower boiling liquid fraction.
Figure 2B:
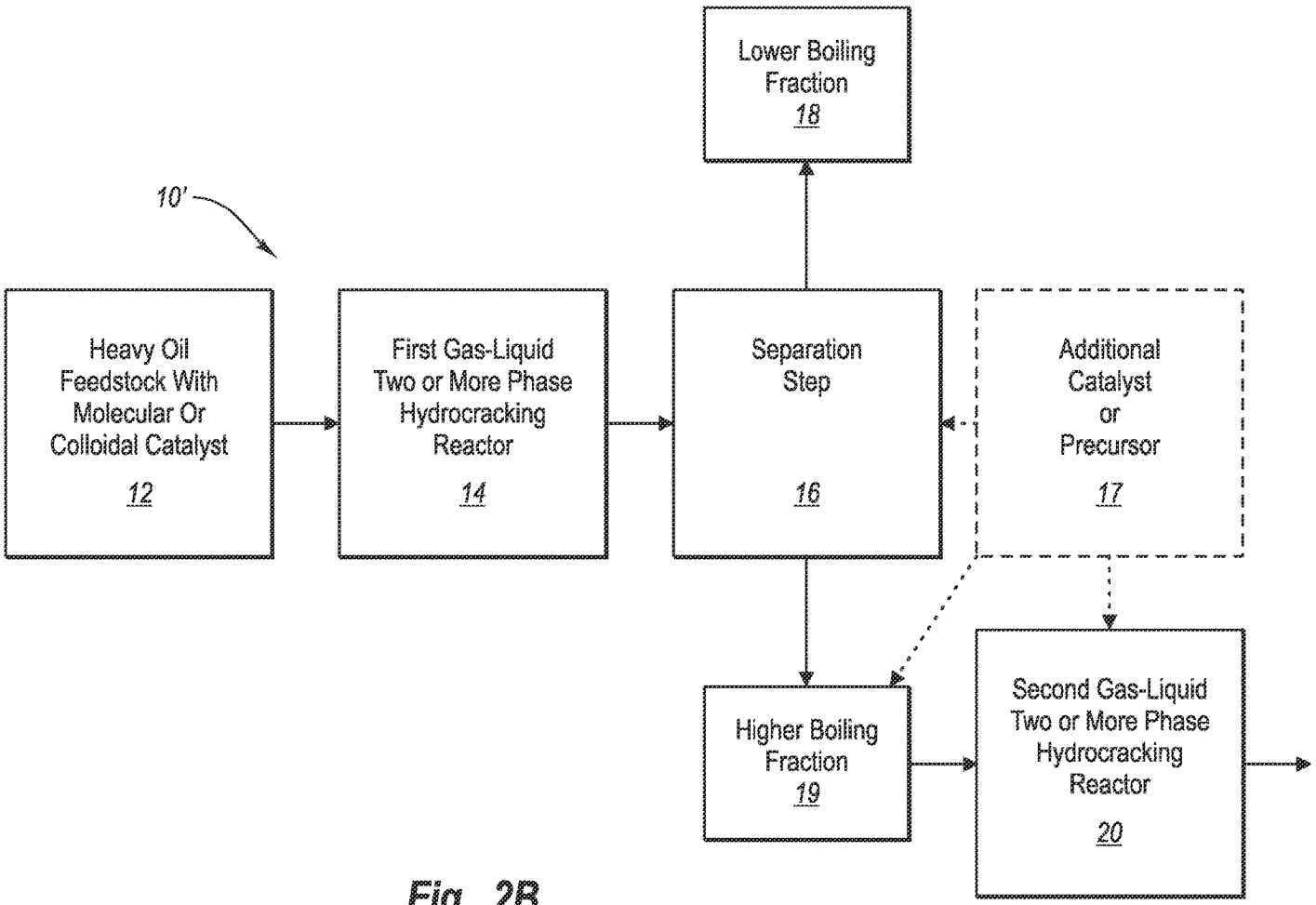
FIG. 2B is a block diagram that schematically illustrates another exemplary hydrocracking system according to the invention for upgrading a heavy oil feedstock in which the concentration of colloidal or molecular catalyst is further increased in a downstream reactor by adding additional catalyst or catalyst precursor.

FIGS. 2A and 2B depict alternative exemplary hydroprocessing systems 10 and 10' according to the invention. As illustrated in FIG. 2A, hydroprocessing system 10 comprises a heavy oil feedstock 12 having a colloidal or molecular catalyst dispersed therein, a first gas-liquid two or more phase hydrocracking reactor 14 within which an upgraded feedstock or material is produced from the heavy oil feedstock, a separation step 16 (e.g., by means of an interstage pressure differential separator) by which upgraded feedstock or material withdrawn from first gas-liquid two-phase hydrocracking reactor 14 is separated into a lower boiling volatile fraction 18 and a higher boiling liquid fraction 19, and a second gas-liquid two or more phase hydrocracking reactor 20 into which the higher boiling liquid fraction 19 is introduced, resulting in additional production of upgraded material from second gas-liquid two or more phase hydrocracking reactor 20.

Depending on the quality of the liquid fraction from the first reactor 14 and/or interstage separator and the amount and/or quality of residual colloidally or molecularly dispersed catalyst in the liquid fraction introduced into second reactor 20, it may be desirable to provide additional colloidal or molecular catalyst within the liquid fraction in the downstream reactor, such as by adding a colloidal or molecular catalyst to the hydrocracking reactor or catalyst precursor to the interstage separator or other location upstream from the downstream hydrocracking reactor.

As illustrated in FIG. 2B, hydroprocessing system 10' is similar to hydroprocessing system 10 of FIG. 2A, except that it also includes a supplemental catalyst addition step 17, which results in a higher concentration of colloidal or molecular catalyst within the second hydrocracking reactor 20. Supplemental catalyst addition step 17 may include one or more of adding a catalyst precursor (or diluted catalyst precursor mixture formed by diluting a catalyst precursor with a hydrocarbon diluent (e.g. as discussed below in relation to FIG. 3) to the higher boiling liquid fraction 19 or to an interstage separator that is utilized in separation step 16. Instead or in addition, supplemental catalyst addition step 17 may include adding an already formed colloidal or molecular catalyst to the higher boiling liquid fraction 19, to an interstage separator that is utilized in separation step 16, or directly to the second reactor 20.

By providing a higher concentration of colloidal or molecular catalyst in the second reactor 20 compared to the concentration of such catalyst in the first reactor 14, hydroprocessing system 10' provides increased system throughput, increased reaction rate, and higher conversion levels of asphaltenes and high boiling lower quality materials compared to hydroprocessing system 10 illustrated in FIG. 2A. Increased conversion levels of asphaltenes and lower quality materials reduces equipment fouling, enables the reactor to process a wider range of lower quality feedstocks, and can optionally facilitate more efficient use of a supported catalyst if such catalyst is used in addition to the colloidal or molecular catalyst.

At least a portion of the increase in catalyst concentration can be obtained by providing additional colloidal or molecular catalyst as discussed herein in addition to whatever colloidal or molecular catalyst remains in the higher boiling liquid fraction after removing the lower boiling vapor fraction from an effluent produced by a first or upstream hydrocracking reactor. The additional colloidal or molecular catalyst added to the hydroprocessing system in order to further increase the concentration of colloidal or molecular catalyst within a second or downstream reactor may account for at least about 5%, 10%, 20%, 35%, 50% or 75% of the increase in concentration of colloidal or molecular catalyst compared to the concentration in the first or upstream reactor.

The heavy oil feedstock 12 may comprise any desired fossil fuel feedstock and/or fraction thereof including, but not limited to, one or more of heavy crude, oil sands bitumen, bottom of the barrel fractions from crude oil, atmospheric tower bottoms, vacuum tower bottoms, coal tar, liquefied coal, and other resid fractions. A common characteristic of heavy oil feedstocks that may advantageously be upgraded using the hydroproces sing methods and systems (according to the invention) is that they include a significant fraction of high boiling point hydrocarbons (i.e., at or above 343° C. (650° F.), more particularly at or above about 524° C. (975° F.)) and/or asphaltenes.

As discussed above and schematically illustrated in FIG. 1, asphaltenes are complex hydrocarbon molecules having a relatively low ratio of hydrogen to carbon, such as the result of including a substantial number of condensed aromatic and naphthenic rings with paraffinic side chains. Sheets comprised of condensed aromatic and naphthenic rings may held together by heteroatoms such as sulfur or nitrogen and/or polymethylene bridges, thio-ether bonds, and vanadium and nickel complexes. The asphaltene fraction also typically contains a higher content of sulfur and nitrogen than does crude oil or the other fractions of vacuum resid, and it also contains higher concentrations of carbon-forming compounds (i.e., aromatic ring structures that can form coke precursors and sediment through dehydrogenation and/or molecular growth).

A significant characteristic of the gas-liquid two or more phase hydrocracking reactors 14 and 20 within exemplary hydroproces sing systems 10, 10' of FIGS. 2A and 2B, respectively, is that the heavy oil feedstock 12 introduced into the first hydrocracking reactor 14 includes a colloidal or molecular catalyst and/or a well-dispersed catalyst precursor composition capable of forming the colloidal or molecular catalyst in situ within the feed heaters and/or the first gas-liquid two or more phase hydrocracking reactor 14. The higher boiling liquid fraction 19 introduced into the second hydrocracking reactor 20 includes an increased concentration of colloidal or molecular catalyst compared to the first hydrocracking reactor 14 as a result of separating lower boiling volatile fraction 18 from higher boiling liquid fraction 19 (i.e., because lower boiling volatile fraction 18 is free or substantially free of colloidal or molecular catalyst) and/or as a result of adding or forming additional colloidal or molecular catalyst in or upstream from second reactor 20. The colloidal or molecular catalyst, the formation of which is discussed in more detail below, is preferably used as the primary or sole catalyst (e.g., without any conventional solid supported catalyst, for example, porous catalysts with active catalytic sites located within the pores).

Separation step 16 preferably comprises a pressure differential interstage separator which subjects the product stream to a pressure drop in order to separate a lower boiling volatile fraction from a higher boiling less-volatile fraction. Differences between a pressure differential interstage separator at separation step 16 within hydroprocessing system 10 and other separators known in the art include the fact that a pressure differential interstage separator operates by subjecting the product stream to a significant pressure drop (e.g., across a valve as the material enters the separator) so as to force a more significant fraction of the product stream to volatilize than would otherwise occur. In other words, there is a significant intentionally induced pressure drop, for example, at least about 100 psi. In addition, the upgraded feedstock or material that is introduced into the separator includes residual colloidal or molecular catalyst dispersed therein as well as dissolved hydrogen. As a result, any hydrocarbon free radicals, including asphaltene free radicals, that are generated within the separator and/or which persist within the upgraded feedstock as withdrawn from the gas-liquid two-phase hydrocracking reactor 14 can be further hydroprocessed in the separator, reducing coke and/or asphaltene formation and deposition.

More particularly, the colloidal or molecular catalyst within the upgraded feedstock or material transferred from first gas-liquid two-phase hydrocracking reactor 14 to an interstage separator is able to catalyze beneficial upgrading or hydrotreating reactions between the hydrocarbon free radicals and hydrogen within the interstage separator. The result is a more stable upgraded feedstock, decreased sediment and coke precursor formation, and decreased fouling of the separator compared to hydroprocessing systems that do not employ a colloidal or molecular catalyst (e.g., conventional ebullated bed systems which require quenching of a separator with cooler oil in order to reduce the tendency of free radicals within the upgraded material to form coke precursors and sediment in a separator in the absence of any catalyst). Furthermore, the induced pressure drop also results in a moderate temperature drop, which further decreases or eliminates any need for quench oil, as well as decreasing any tendency of free radicals to form coke precursors and sediment.

In addition, because the colloidal or molecular catalyst from the first reactor can remain with the higher boiling liquid fraction 19 from separation step 16, the catalyst can be easily passed in higher concentration with liquid fraction 19 to second hydrocracking reactor 20 for further processing. By removing the lower boiling volatile fraction 18 (which is not introduced into second hydrocracking reactor 20) from the higher boiling liquid fraction 19, the volume of material to be treated within second reactor 20 is less than if no separation were performed. And in embodiments that employ a interstage pressure differential separator that induces and subjects the effluent from first reactor 14 to a significant pressure drop, the lower boiling volatile fraction 18 also represents a greater percentage of the effluent from first reactor 14 than it otherwise would if a different type separator were used in which no pressure drop were applied. Increasing the percentage of the effluent which is separated with lower boiling volatile fraction 18 likewise further decreases the volume of higher boiling liquid fraction 19 to be further reacted within second reactor 20. Furthermore, removal of low boiling point components from the stream 19 prior to introduction into second reactor 20 results in reduced gas hold up (i.e., gases occupy less of the reactor volume, and the partial pressure and/or fraction of hydrogen gas as a fraction of total gas volume is increased).

Although separation step 16 may include an interstage pressure differential separator in a preferred embodiment, separation step 16 may alternatively comprise the step of removing a lower boiling gaseous/vapor fraction 18 from first gas-liquid two or more phase reactor 14, without the use of any particular separation unit (i.e., a gaseous vapor fraction present at the top of first reactor 14 may simply be drawn off separately from the liquid effluent from reactor 14). Of course, another alternative may include both removing a lower boiling gaseous/vapor fraction 18 from first reactor 14, without the use of any particular separation unit, followed by introducing the remaining higher boiling effluent from the first reactor 14 into a pressure differential separator so as to flash off an additional fraction of lower boiling materials from the effluent before introducing the bottom fraction from the separator into a second reactor.

Figure 3:
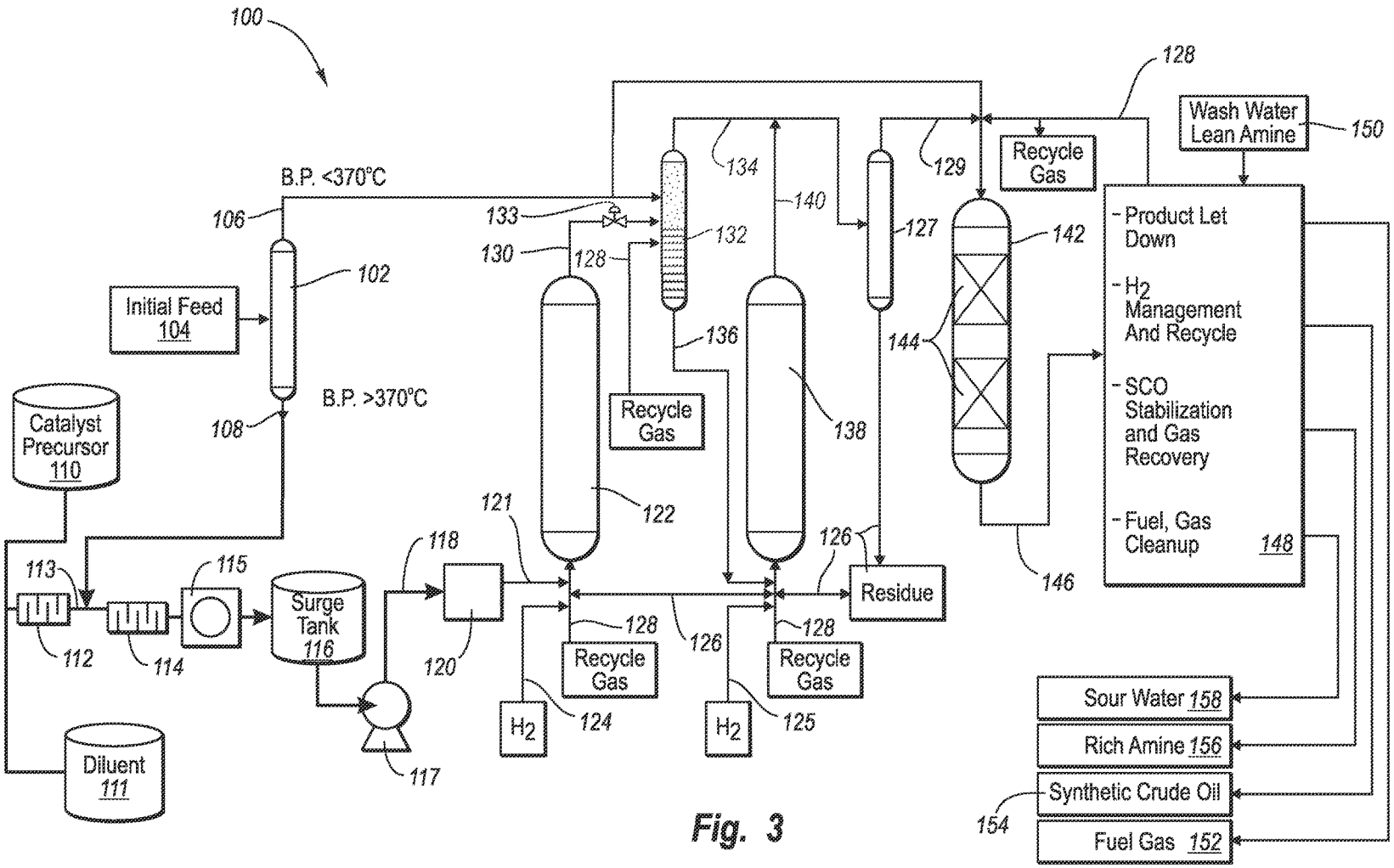
FIG. 3 schematically illustrates a refining system that includes an exemplary hydrocracking system according to the invention as a module within the overall system.

FIG. 3 depicts an exemplary refining system 100 that incorporates an exemplary hydrocracking system according to the invention (e.g. as illustrated in FIG. 2A or 2B). The refining system 100 may itself comprise a module within an even more detailed and complex oil refinery system, including a module that is added to a pre-existing refinery system as part of an upgrade. The refining system 100 more particularly includes a distillation tower 102 into which an initial feed 104 comprising a significant fraction of higher boiling hydrocarbons is introduced. By way of example and not limitation, gases and/or lower boiling hydrocarbons 106 having a boiling point less than 370° C. (698° F.) are separated from a higher boiling liquid fraction 108 comprising materials having a boiling point greater than 370° C. (698° F.). In this embodiment, the higher boiling liquid fraction 108 comprises a "heavy oil feedstock" within the meaning of this term.

According to one embodiment, an oil soluble catalyst precursor composition 110 is preblended with a hydrocarbon oil fraction or diluent 111 and mixed for a period of time in a pre-mixer 112 to form a diluted precursor mixture 113 in which the precursor composition 110 is well-mixed with the diluent 111. By way of example and not limitation, the pre-mixer 112 may be a multistage in-line low shear static mixer. Examples of suitable hydrocarbon diluents 111 include, but are not limited to, start up diesel (which typically has a boiling range of about 150° C. or higher), vacuum gas oil (which typically has a boiling range of 360-524° C.) (680-975° F.), decant oil or cycle oil (which typically has a boiling range of 360-550° C.) (680-1022° F.), and/or light gas oil (which typically has a boiling range of 200-360° C.) (392-680° F.). In some embodiments, it may be possible to dilute the catalyst precursor composition with a small portion of the heavy oil feedstock 108. Although the diluent may contain a substantial fraction of aromatic components, this is not required in order to keep the asphaltene fraction of the feedstock in solution, as the well dispersed catalyst is able to hydrocrack the asphaltenes within the heavy oil feedstock as well as the other components of the feedstock.

According to one embodiment, the catalyst precursor composition 110 is mixed with the hydrocarbon diluent 111 at a temperature below which a significant portion of the catalyst precursor composition 110 starts to decompose, e.g., in a range of about 25° C. (77° F.) to about 300° C. (572° F.), most preferably in a range of about 75° C. (167° F.) to about 150° C. (302° F.), to form the diluted precursor mixture. It will be appreciated that the actual temperature at which the diluted precursor mixture is formed typically depends at least in part on the decomposition temperature of the particular precursor composition that is used.

It has been found that pre-blending the precursor composition 110 with a hydrocarbon diluent 111 to form a diluted precursor mixture prior to blending with the heavy oil feedstock 108 greatly aids in thoroughly and intimately blending the precursor composition 110 within feedstock 108, particularly in the relatively short period of time required for large-scale industrial operations to be economically viable. Forming a diluted precursor mixture advantageously shortens the overall mixing time by (1) reducing or eliminating differences in solubility between a more polar catalyst precursor 102 and a less polar heavy oil feedstock 108; (2) reducing or eliminating differences in rheology between the catalyst precursor composition 102 and the heavy oil feedstock 108; and/or (3) breaking up bonds or associations between clusters of catalyst precursor molecules to form a solute within hydrocarbon oil diluent 104 that is much more easily dispersed within the heavy oil feedstock 108.

For example, it is particularly advantageous to first form a diluted precursor mixture in the case where the heavy oil feedstock 108 contains water (e.g., condensed water). Otherwise, the greater affinity of the water for the polar catalyst precursor composition 110 can cause localized dissolution and/or agglomeration of the precursor composition 110, resulting in poor dispersion and formation of micron-sized or larger catalyst particles. The hydrocarbon oil diluent 111 is preferably substantially water free (i.e., contains less than about 0.5% water) to prevent the formation of substantial quantities of micron-sized or larger catalyst particles.

The diluted precursor mixture 113 is then combined with heavy oil feedstock 108 and mixed for a time sufficient and in a manner so as to disperse the catalyst precursor composition throughout the feedstock in order to yield a blended feedstock composition in which the precursor composition is thoroughly mixed within the heavy oil feedstock. In the illustrated system, heavy oil feedstock 108 and the diluted catalyst precursor 113 are blended in a second multistage low shear, static in-line mixer 114.

Second in-line static mixer 114 is followed by further mixing within a dynamic, high shear mixer 115 (e.g., a vessel with a propeller or turbine impeller for providing very turbulent, high shear mixing). Static in-line mixer 114 and dynamic high shear mixer 115 may be followed by a pump around in surge tank 116, and/or one or more multi-stage centrifugal pumps 117. According to one embodiment, continuous (as opposed to batch) mixing can be carried out using high energy pumps having multiple chambers within which the catalyst precursor composition and heavy oil feedstock are churned and mixed as part of the pumping process itself used to deliver a conditioned heavy oil feedstock 118 to the hydroprocessing reactor system.

Although illustrated with a specific arrangement of inline mixers 112, 114, and high shear mixer 115 it is to be understood that the illustrated example is simply a non-limiting exemplary mixing scheme for intimately mixing the catalyst precursor with the heavy oil feedstock. Modifications to the mixing process are possible. For example, in one embodiment, rather than mixing the diluted precursor mixture with all of heavy oil feedstock 108 at once, only a portion of heavy oil feedstock 108 may initially be mixed with the diluted catalyst precursor. For example, the diluted catalyst precursor may be mixed with a fraction of the heavy oil feedstock, the resulting mixed heavy oil feedstock can be mixed in with another fraction of the heavy oil feedstock, and so on until all of the heavy oil feedstock has been mixed with the diluted catalyst precursor. Additional details regarding processes for intimately mixing the catalyst precursor with the heavy oil feedstock are described in U.S. patent application Ser. No. 11/374,369 filed Mar. 13, 2006 and entitled METHODS AND MIXING SYSTEMS FOR INTRODUCING CATALYST PRECURSOR INTO HEAVY OIL FEEDSTOCK, herein incorporated by reference.

The finally conditioned feedstock 118 is introduced into a pre-heater or furnace 120 so as to heat the finally conditioned feedstock 118 to a temperature that is about 100° C. (212° F.), preferably about 50° C. (122° F.) below the temperature in first gas-liquid two or more phase hydrocracking reactor 122. The oil soluble catalyst precursor composition 110 dispersed throughout the feedstock 108 decomposes and combines with sulfur released from the heavy oil feedstock 108 to yield a colloidal or molecular catalyst as the conditioned feedstock 118 travels through the pre-heater of furnace 120 and is heated to a temperature higher than the decomposition temperature of the catalyst precursor composition.

This yields a prepared feedstock 121, which is introduced under pressure into first gas-liquid two or more phase hydrocracking reactor 122. Hydrogen gas 124 is also introduced into first gas-liquid two or more phase reactor 122 under pressure in order to effect hydrocracking of the prepared feedstock 121 within first gas-liquid two or more phase reactor 122. Heavy oil resid bottoms 126 and/or recycle gas 128 produced downstream from first gas-liquid two or more phase hydrocracking reactor 122 may optionally be recycled back into first gas-liquid two or more phase reactor 122 with prepared feedstock 121. Any recycled resid bottoms 126 advantageously includes a relatively high concentration of residual colloidal and/or molecular catalyst dispersed therein, as will be apparent from the present disclosure. The recycle gas 128 advantageously includes hydrogen.

The prepared feedstock 121 introduced into first gas-liquid two or more phase hydrocracking reactor 122 is heated to or maintained at a hydrocracking temperature, which causes the prepared feedstock 121, in combination with catalyst and hydrogen in first gas-liquid two or more phase reactor 122, to be upgraded so as to form an upgraded feedstock 130 that is withdrawn at the top of first gas-liquid two or more phase reactor 122. According to one embodiment, the upgraded feedstock 130 is transferred directly to pressure differential interstage separator 132 through a valve 133, optionally together with at least a portion of the lower boiling point fraction 106 from the distillation tower 102 and/or recycle gas 128 produced downstream. Interstage separator 132 operates by subjecting the feed components 130 and optionally 106 and 128 to a pressure drop (e.g., across valve 133 as the material enters separator 132) relative to the pressure at which first gas-liquid two or more phase reactor 122 operates. For example, in one embodiment the first gas-liquid two-phase hydrocracking reactor may operate at a pressure between about 1500 psig and about 3500 psig, more preferably between about 2000 psig and about 2800 psig, and most preferably between about 2200 and about 2600 psig (e.g., 2400 psig). Valve 133 and interstage separator 132 induce a significant pressure drop to the incoming feed. For example, the pressure drop may be in a range between about 100 psi and about 1000 psi, more preferably between about 200 psi and about 700 psi, and most preferably between about 300 psi and about 500 psi.

Lower boiling volatile gaseous vapor fraction 134 (e.g., including $H_2$, $C_1$-$C_7$ hydrocarbons, and other lower boiling components depending on the degree of the pressure drop) is removed from the top of interstage separator 132 and sent downstream for further processing. A higher boiling liquid fraction 136 is withdrawn from the bottom of interstage separator 132. The higher boiling liquid fraction 136 withdrawn from the bottom of interstage separator 132 has a concentration of colloidally or molecularly dispersed catalyst which is significantly higher than the catalyst concentration within effluent 130 from first gas-liquid two or more phase hydrocracking reactor 122. The catalyst concentration is similarly significantly higher than the catalyst concentration of prepared feedstock 121. This is because the catalyst is not held within lower boiling volatile phase 134 withdrawn from interstage separator 132; rather substantially all of the catalyst concentrates within higher boiling liquid fraction 136. Additional colloidal or molecular catalyst and/or precursor composition may be added to interstage separate 132 and/or to higher boiling liquid fraction 136 in order to further increase the concentration of colloidal or molecular catalyst.

Higher boiling liquid fraction 136 may then be reacted within a second gas-liquid two or more phase hydrocracking reactor 138 to increase the overall conversion level of the heavy oil feedstock. Such a system allows for a reduction in volume of material to be treated within the second gas-liquid two or more phase hydrocracking reactor 138, does not require any complex or expensive separation scheme to retrieve catalyst from high quality lower boiling volatile fraction 134, does not require the addition of new catalyst (which would be an added expense), and provides increased catalyst concentration within the material introduced into second gas-liquid two-phase hydrocracking reactor 138, as well as increased asphaltene/lower quality components concentration, which increase reaction rate and conversion levels. In addition, second gas-liquid two or more phase hydrocracking reactor 138 may be of a smaller volume than first gas-liquid two or more phase hydrocracking reactor 122, as the volume of material stream 136 to be treated is relatively smaller, and the concentration of colloidal or molecular catalyst is increased relative to the catalyst concentration within stream 121 introduced into first gas-liquid two or more phase reactor 122.

Because of the pressure drop induced at interstage separator 132 and valve 133, second gas-liquid two or more phase reactor 138 may operate at a lower pressure than first gas-liquid two or more phase reactor 122. For example, in one embodiment first gas-liquid two or more phase reactor 122 may operate at about 2400 psig, while second gas-liquid two or more phase reactor 138 may operate at about 2000 psig, the pressure differential being a result of the pressure drop across valve 133 at interstage separator 132. Of course, the operating pressure of second reactor 138 may be raised by the addition of more hydrogen gas 125. For example, sufficient hydrogen gas 125 may be added under pressure to second reactor 138 so that both reactors 122 and 138 operate at approximately the same pressure.

Second gas-liquid two or more phase hydrocracking reactor 138 is maintained at a hydrocracking temperature, which causes higher boiling liquid fraction 136, in combination with catalyst and hydrogen 125 in second gas-liquid two or more phase reactor 138, to be upgraded so as to form an upgraded feedstock 140 that is withdrawn at the top of second gas-liquid two or more phase reactor 138. According to one embodiment, the upgraded feedstock 140 is combined with the lighter lower boiling volatile gaseous vapor fraction 134 removed from interstage separator 132, which combined stream may then be introduced into a hot separator 127 to separate out any remaining high boiling fraction materials that may either be used as a residue 126 or recycled back into one or both of hydrocracking gas-liquid two or more phase reactors 122 and/or 138. Hot separator 127 induces no significant pressure drop (e.g., not more than about 25 psi, more typically not more than about 10 psi). The residue 126 may also be used as a feedstock to provide gaseous product in a gasification reactor.

The catalyst concentration within the higher boiling bottoms liquid fraction introduced into the second gas-liquid two or more phase hydrocracking reactor 138 typically will have a catalyst concentration that is between about 10 percent and about 100 percent higher than the concentration of the catalyst present within the effluent from the first gas-liquid two or more phase hydrocracking reactor 122. More preferably, the catalyst concentration within the higher boiling bottoms liquid fraction introduced into the second gas-liquid two or more phase hydrocracking reactor 138 is between about 20 percent and about 50 percent (e.g., at least about 25 percent higher) than the concentration of the catalyst present within the effluent from the first gas-liquid two or more phase reactor 122, and most preferably the concentration within the higher boiling bottoms liquid fraction introduced into the second hydrocracking reactor 138 is between about 25 percent and about 40 percent (e.g., at least about 30 percent higher) than the concentration of the catalyst present within the effluent from the first hydrocracking reactor 122.

Stated another way, preferably about 10 percent to about 50 percent of the material is flashed off using interstage separator 132, more preferably between about 15 percent and about 35 percent of the material is flashed off using interstage separator 132, and most preferably between about 20 percent and about 30 percent of the material is flashed off using interstage separator 132.

Stream 129 (optionally with all or a portion of stream 106) may then be introduced into a mixed feed hydrotreater 142, which comprises one or more beds of solid supported catalyst 144 that effects hydrotreatment of the materials introduced therein. Mixed feed hydrotreater 142 is an example of a fixed bed reactor.

The hydrotreated material 146 is withdrawn from the hydrotreater 142 and then subjected to one or more downstream separation or cleaning processes 148. Recycle gas 128 comprising hydrogen may be recycled back into the gas-liquid two-phase reactors 122 and/or 138 and/or interstage separator 132 and/or hot separator 127, as desired. Hydrogen containing recycle gas 128 acts to reduce coke formation and fouling within separators 132 and 127. Wash water and lean amine 150 may be used to wash the hydrotreated material 146 in order to yield a variety of products, including fuel gas 152, synthetic crude oil 154, rich amine 156, and sour water 158. The lean amine may also be used to remove $H_2S$. The wash water is used to dissolve ammonium salts which otherwise may form crystals that can become deposited on the equipment, thereby restricting fluid flow.

Figure 4:
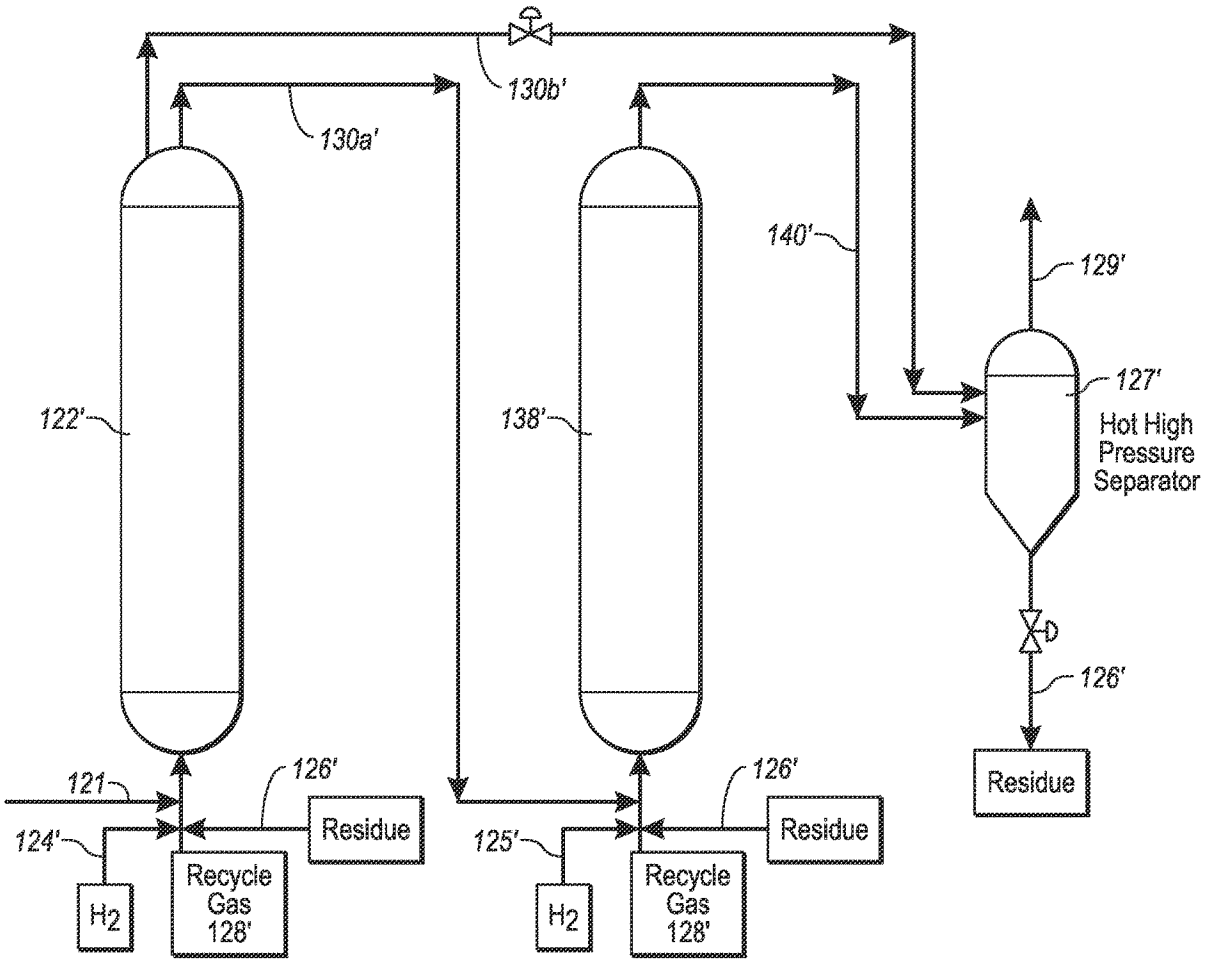
FIG. 4 schematically illustrates an alternative hydrocracking system.

FIG. 4 illustrates an alternative hydroprocessing system that may form part of a larger refining process (e.g., similar to the overall process illustrated in FIG. 3). For example, reactors 122 and 138, valve 133, interstage separator 132, and hot separator 127 of FIG. 3 may be replaced with the alternative hydroprocessing system shown in FIG. 4. As shown in FIG. 4, prepared feedstock 121 is introduced under pressure into first gas-liquid two or more phase hydrocracking reactor 122'. Hydrogen gas 124' is also introduced into first gas-liquid two or more phase reactor 122' under pressure in order to effect hydrocracking of the prepared feedstock 121 within first gas-liquid two or more phase reactor 122'. Heavy oil resid bottoms 126' and/or recycle gas 128' produced downstream from first gas-liquid two or more phase hydrocracking reactor 122' may optionally be recycled back into first gas-liquid two or more phase reactor 122'. Within the inventive systems, any recycled resid bottoms 126' advantageously includes an extremely elevated concentration of residual colloidal or molecular catalyst dispersed therein. The recycle gas 128' advantageously includes hydrogen.

The prepared feedstock 121 within first gas-liquid two or more phase hydrocracking reactor 122' is heated or maintained at a hydrocracking temperature and pressure (e.g., about 2000 psig), which causes or allows the prepared feedstock 121, in combination with catalyst and hydrogen in first gas-liquid two or more phase reactor 122', to be upgraded so as to form an upgraded feedstock that is withdrawn at the top of first gas-liquid two or more phase reactor 122' as a liquid fraction stream **130*a*' and a gaseous vapor fraction stream 130*b*'. For example, vapor stream 130*b*' may be withdrawn through a pipe or other outlet which collects material from a vapor pocket at the top of gas-liquid two or more phase reactor 138'—as compared to withdrawal of stream 130*a*', which may be accomplished by submerging the outlet pipe into the liquid phase within reactor 122' located below the vapor pocket from which stream 130*b*' is drawn. Although it may be possible for stream 130*b*' to bypass separator 127' and combine it directly with stream 129', this is discouraged as the separation between vapor stream 130*b*' and liquid stream 130*a*' can be difficult, particularly under the temperatures and pressures at which first gas-liquid two or more phase reactor 122' operates. In other words, there will likely be at least a small fraction of higher boiling liquid component contamination within stream 130*b*', and introducing stream 130*b*' into separator 127' removes any such constituents back to residue stream 126'. As illustrated, the volatile gaseous vapor fraction stream 130*b*' is transferred directly to a separator (e.g., hot high pressure separator 127'), while liquid fraction stream 130*a*' is introduced into second gas-liquid two or more phase hydrocracking reactor 138'. Similar to the embodiment illustrated within FIG. 3**, a lower boiling volatile portion of the effluent from the first gas-liquid two or more phase hydrocracking reactor is separated from the upgraded feedstream before introducing the liquid fraction of the upgraded material into the second gas-liquid two or more phase hydrocracking reactor.

A principal difference between the embodiments illustrated in FIGS. 3 and 4 is that the embodiment illustrated in FIG. 3 includes a pressure differential interstage separator and associated valve through which all of the upgraded feedstock 130 is fed so as to separate a lower boiling volatile fraction from a higher boiling bottoms fraction. Because a significant pressure differential is applied to the feed, the low boiling volatile fraction that is separated removes materials having higher boiling points than the separation as illustrated in FIG. 4 (because no pressure differential is applied in the separation of streams **130*a*' and 130*b*' illustrated in FIG. 4). In other words, the pressure differential as applied in the process of FIG. 3 forces less volatile liquid components (i.e., having higher boiling points than more volatile liquid components) that would otherwise remain in the liquid stream 130*a*' of FIG. 4 to volatilize into the vapor stream within the process of FIG. 3. All things being equal, the process of FIG. 3 results in a greater reduction in the volume of material being introduced into the second gas-liquid two or more phase hydrocracking reactor 138 and a greater increase in concentration of the catalyst within the liquid feedstock being introduced into that reactor. As such, the process of FIG. 3 may be preferred, although the process of FIG. 4 still provides some of the benefits of the system of FIG. 3**, just to a smaller degree, likely at a lower cost, and in a way that may easily accommodate retrofitting to an existing reactor system.

The higher boiling liquid fraction 130*a*' withdrawn from first gas-liquid two or more phase reactor 122' has a concentration of colloidally or molecularly dispersed catalyst which is significantly higher (e.g., at least about 10 percent higher) than the catalyst concentration within prepared feedstock 121 fed to first gas-liquid two or more phase reactor 122'. This is because the colloidal or molecular catalyst is not held within volatile phase 130*b*' withdrawn from first reactor 122' so that substantially all of the catalyst concentrates within higher boiling liquid fraction 130*a*'. As compared to a conventional slurry catalyst, which can become entrained within a lower boiling material removed from a pressure differential separator, the colloidal or molecular catalyst has a higher affinity for, and therefore has a higher propensity to remain within, the higher boiling liquid fraction compared to a conventional slurry catalyst. That is because the interactions between the much smaller colloidal or molecular catalyst and the liquid hydrocarbon fraction are more chemical in nature (i.e., owning to the much higher surface to mass ratio) compared to a conventional slurry catalyst. Higher boiling liquid fraction 130*a*' may then be reacted within second gas-liquid two or more phase hydrocracking reactor 138' to increase conversion levels of the heavy oil feedstock within the overall process.

Similar to the system module within FIG. 3, the system module of FIG. 4 provides a reduced volume of material to be treated within the second gas-liquid two or more phase hydrocracking reactor (i.e., stream 130*a*' is smaller than stream 121), does not require any complex or expensive separation scheme to retrieve catalyst from lower boiling volatile fraction 130*a*' (in this regard it is even simpler than the system of FIG. 3), and provides increased catalyst concentration within the material introduced into second gas-liquid two or more phase hydrocracking reactor 138', which increases reaction rate and overall conversion levels relative to a system that does not include such a reaction system in which a volatile fraction is removed before introduction of the effluent from the first gas-liquid two or more phase reactor into the second gas-liquid two or more phase reactor. Moreover, to the extent that the system module of FIG. 4 does not result in a desired high concentration of colloidal or molecular catalyst for feeding into second reactor 138', additional colloidal or molecular catalyst can be added to and/or formed within the higher boiling liquid fraction introduced into the second reactor 138' to provide a desired high concentration of colloidal or molecular catalyst.

Similar to the system of FIG. 3, second gas-liquid two or more phase hydrocracking reactor 138' may be of a smaller volume than first gas-liquid two or more phase hydrocracking reactor 122' as the volume of material stream 130*a*' to be treated is relatively smaller, and the concentrations of both the asphaltene/lower quality components, as well as the colloidally or molecularly dispersed catalyst are increased relative to the concentrations within stream 121 introduced into first gas-liquid two or more phase reactor 122'.

Second gas-liquid two or more phase hydrocracking reactor 138' is maintained at a hydrocracking temperature and pressure (e.g., about 2000 psig), which causes higher boiling liquid fraction 130*a*', in combination with catalyst and hydrogen 125' in second gas-liquid two or more phase reactor 138', to be upgraded so as to form an upgraded feedstock 140' that is withdrawn at the top of second gas-liquid two or more phase reactor 138'. The upgraded feedstock 140' is fed with lower boiling volatile gaseous vapor stream 130*b*' into hot high pressure separator 127' to separate out any remaining high boiling fraction materials that may either be used as a residue 126' or recycled back into one or both hydrocracking gas-liquid two or more phase reactors 122' and 138'. The residue 126' may also be used as a feedstock to provide gaseous product in a gasification reactor.

The overhead lower boiling volatile fraction 129' from hot high pressure separator 127' may then be introduced downstream for additional hydrotreating (e.g., fed into a mixed feed hydrotreater for further downstream treatment, for example as shown in FIG. 3). Separator 127' operates without inducing any significant pressure drop (e.g., not more than about 25 psi, more typically not more than about 10 psi). The embodiment illustrated in FIG. 4 may be particularly advantageous in retrofitting an existing reactor system (e.g., a three-phase ebullated bed reactor system), as the vapor products may be withdrawn from first hydrocracking reactor 122', reducing gas hold up within both the first and second reactors. Such a retrofit to an existing reactor system allows for higher liquid flow rates or higher overall conversion levels to be achieved with a minimum of capital investment.

Figure 5:
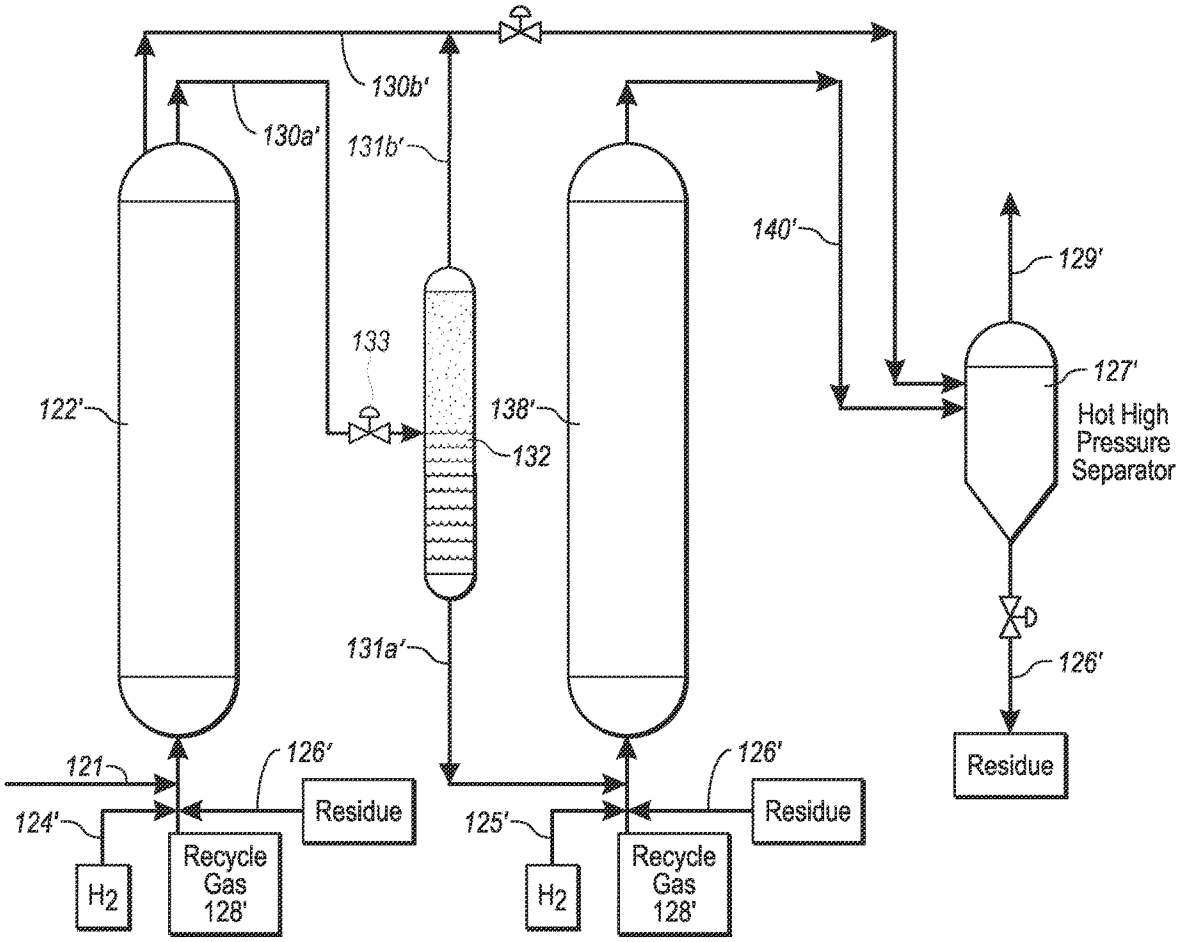
FIG. 5 schematically illustrates another example of an inventive hydrocracking system.

FIG. 5 illustrates another exemplary hydrocracking system that may form part of a larger refining process (e.g., similar to the overall process illustrated in FIG. 3). The system of FIG. 5 is similar to that shown in FIG. 4, except that the higher boiling effluent from the first two or more phase hydrocracking reactor is fed through a valve 133 and interstage separator 132, effectively combining features from the systems of both FIG. 3 and FIG. 4. Similar to in FIG. 4, prepared feedstock 121 is introduced under pressure into first gas-liquid two or more phase hydrocracking reactor 122'. Hydrogen gas 124' is also introduced into first gas-liquid two or more phase reactor 122' under pressure in order to effect hydrocracking of the prepared feedstock 121 within first gas-liquid two or more phase reactor 122'. Heavy oil resid bottoms 126' and/or recycle gas 128' produced downstream from first gas-liquid two or more phase hydrocracking reactor 122' may optionally be recycled back into first gas-liquid two or more phase reactor 122'.

The higher boiling liquid fraction 130*a*' withdrawn from first gas-liquid two or more phase reactor 122' has a concentration of colloidal or molecular catalyst that is significantly higher (e.g., at least about 10 percent higher) than the concentration of colloidal or molecular catalyst within prepared feedstock 121 fed to first gas-liquid two or more phase reactor 122'. Higher boiling liquid fraction 130*a*' may then be introduced into pressure differential separator 132 through valve 133. A pressure drop is induced across valve 133, causing a separation between lower boiling volatile gaseous vapor fraction 131*b*' and a higher boiling liquid fraction 131*a*'. The higher boiling liquid fraction 131*a*' withdrawn from the bottom of interstage separator 132 has a concentration of colloidal or molecular catalyst that is significantly higher than the concentration of colloidal or molecular catalyst within effluent 130*a*' and prepared feedstock 121. Higher boiling liquid fraction 131*a*' is reacted within second gas-liquid two or more phase hydrocracking reactor 138' to increase conversion levels of the heavy oil feedstock within the overall process. An upgraded feedstock 140' is withdrawn at the top of second gas-liquid two or more phase reactor 138'. The upgraded feedstock 140' is fed with lower boiling volatile gaseous vapor stream 130*b*' and stream 131*b*' into hot high pressure separator 127' to separate out any remaining high boiling fraction materials that may either be used as a residue 126' or recycled back into one or both hydrocracking gas-liquid two or more phase reactors 122' and 138'. The first and second hydrocracking gas-liquid two or more phase reactors of FIGS. 3-5 may contain a recycle channel, recycling pump, and distributor grid plate as in a conventional ebullated bed reactor to promote more even dispersion of reactants, catalyst, and heat (e.g., in a manner similar to conventional ebullated bed reactors).

IV. Preparation and Characteristics of Colloidal or Molecular Catalyst

According to one embodiment, the colloidal or molecular catalyst is formed by initially mixing a catalyst precursor composition within a heavy oil feedstock to form a blended or conditioned feedstock composition. After the catalyst precursor composition has been well-mixed throughout the heavy oil feedstock so as to yield the blended feedstock composition, this composition is then heated to above the temperature where significant decomposition of the catalyst precursor composition occurs in order to liberate the catalyst metal therefrom so as to form the final active catalyst. According to one embodiment, the metal from the precursor composition is believed to first form a metal oxide, which then reacts with sulfur liberated from the heavy oil feedstock to yield a metal sulfide compound that is the final active catalyst. In the case where the heavy oil feedstock includes sufficient or excess sulfur, the final activated catalyst may be formed in situ by heating the conditioned heavy oil feedstock to a temperature sufficient to liberate the sulfur therefrom. In some cases, sulfur may be liberated at the same temperature that the precursor composition decomposes. In other cases, further heating to a higher temperature may be required.

The oil soluble catalyst precursor preferably has a decomposition temperature in a range from about 100° C. (212° F.) to about 350° C. (662° F.), more preferably in a range of about 150° C. (302° F.) to about 300° C. (572° F.), and most preferably in a range of about 175° C. (347° F.) to about 250° C. (482° F.). Examples of exemplary catalyst precursor compositions include organometallic complexes or compounds, more specifically, oil soluble compounds or complexes of transition metals and organic acids. A currently preferred catalyst precursor is molybdenum 2-ethylhexanoate (also commonly known as molybdenum octoate) containing 15% by weight molybdenum and having a decomposition temperature or range high enough to avoid substantial decomposition when mixed with a heavy oil feedstock at a temperature below about 250° C. (482° F.). Other exemplary precursor compositions include, but are not limited to, molybdenum naphthanate, vanadium naphthanate, vanadium octoate, molybdenum hexacarbonyl, vanadium hexacarbonyl, and iron pentacarbonyl.

The colloidal or molecular catalyst generally never becomes deactivated because it is not contained within the pores of a support material. Moreover, because of intimate contact with the heavy oil molecules, the molecular catalyst and/or colloidal catalyst particles can rapidly catalyze a hydrogenation reaction between hydrogen atoms and free radicals formed from the heavy oil molecules. Although the molecular or colloidal catalyst leaves the hydroprocessing reactor with the liquid fraction of upgraded product effluent, it is constantly being replaced with fresh catalyst contained in the incoming feedstock and/or recycled residue in which the catalyst has become highly concentrated. As a result, process conditions, throughput and conversion levels remain significantly more constant over time compared to processes that employ solid supported catalysts as the sole hydroprocessing catalyst. Moreover, because the colloidal or molecular catalyst is more freely dispersed throughout the feedstock, including being intimately associated with asphaltenes, conversion levels and throughput can be significantly or substantially increased compared to conventional hydroprocessing systems.

The uniformly dispersed colloidal or molecular catalyst is also able to more evenly distribute the catalytic reaction sites throughout the reaction chamber and feedstock material. This reduces the tendency for free radicals to react with one another to form coke precursor molecules and sediment compared to ebullated bed reactors that only use a relatively large (e.g., ¼"×⅛" or ¼"×1/16") (6.35 mm×3.175 mm or 6.35 mm×1.5875 mm) supported catalyst, wherein the heavy oil molecules must diffuse into the pores of the catalyst support to reach the active catalyst sites. As will be apparent to one skilled in the art, a typical ebullated bed reactor inherently has catalyst free zones at the reactor bottom (plenum) and from above the expanded catalyst level to the recycle cup. In these catalyst free zones the heavy oil molecules continue undergoing thermal cracking reactions so as to form free radicals that may react with one another to produce coke precursor molecules and sediment.

The benefits resulting from the use of the colloidal and/or molecular catalyst and its concentration within the higher boiling effluent fraction and the residue within the inventive processing systems include increased hydrogen transfer to cracked hydrocarbon molecules enabling higher conversion levels and throughput, reduced volume of material requiring treatment within second gas-liquid two-phase reactor 138 or 138' relative to the volume of material treated within first gas-liquid two-phase reactor 122 or 122', and more efficient use of catalyst (the same catalyst is used sequentially within both the first gas-liquid two-phase reactor (i.e., reactor 122 or 122' and the second gas-liquid two-phase reactor (i.e., reactor 138 or 138').

If the oil soluble catalyst precursor is thoroughly mixed throughout the heavy oil feedstock, at least a substantial portion of the liberated metal ions will be sufficiently sheltered or shielded from other metal ions so that they can form a molecularly-dispersed catalyst upon reacting with sulfur to form the metal sulfide compound. Under some circumstances, minor agglomeration may occur, yielding colloidal-sized catalyst particles. Simply mixing, while failing to sufficiently blend, the catalyst precursor composition with the feedstock typically causes formation of large agglomerated metal sulfide compounds that are micron-sized or larger. However, it is believed that taking care to thoroughly mix the precursor composition throughout the feedstock (e.g., with premixing processes as described above in conjunction with FIG. 3) will yield individual catalyst molecules rather than colloidal particles. In addition, it is believed that the molecularly dispersed catalyst remains molecularly dispersed when concentrated within the higher boiling liquid effluent fraction and residue 126, allowing this material to be further hydrocracked without requiring any additional process to intimately disperse the catalyst within the material.

In order to form the metal sulfide catalyst, the blended feedstock composition is preferably heated to a temperature in a range of about 200° C. (392° F.) to about 500° C. (932°

F.), more preferably in a range of about 250° C. (482° F.) to about 450° C. (842° F.), and most preferably in a range of about 300° C. (572° F.) to about 400° C. (752° F.). According to one embodiment, the conditioned feedstock is heated to a temperature that is about 100° C. (212° F.) less than the hydrocracking temperature within the hydrocracking reactor, preferably about 50° C. (122° F.) less than the hydrocracking temperature. According to one embodiment, at least a portion of the colloidal or molecular catalyst is formed during preheating before the heavy oil feedstock is introduced into the hydrocracking reactor. According to another embodiment, at least a portion of the colloidal or molecular catalyst is formed in situ within the hydrocracking reactor itself. In some cases, the colloidal or molecular catalyst can be formed as the heavy oil feedstock is heated to a hydrocracking temperature prior to or after the heavy oil feedstock is introduced into a gas-liquid two-phase hydrocracking reactor.

The initial concentration of colloidal or molecular catalyst metal in the feedstock processed in a first hydrocracking reactor is preferably in a range of about 5 parts per million (ppm) to about 500 ppm by weight of the heavy oil feedstock, more preferably in a range of about 15 ppm to about 300 ppm, and most preferably in a range of about 25 ppm to about 175 ppm. As described above, the colloidal or molecular catalyst becomes more concentrated as volatile fractions are removed from higher boiling liquid bottoms fractions.

Figure 6:
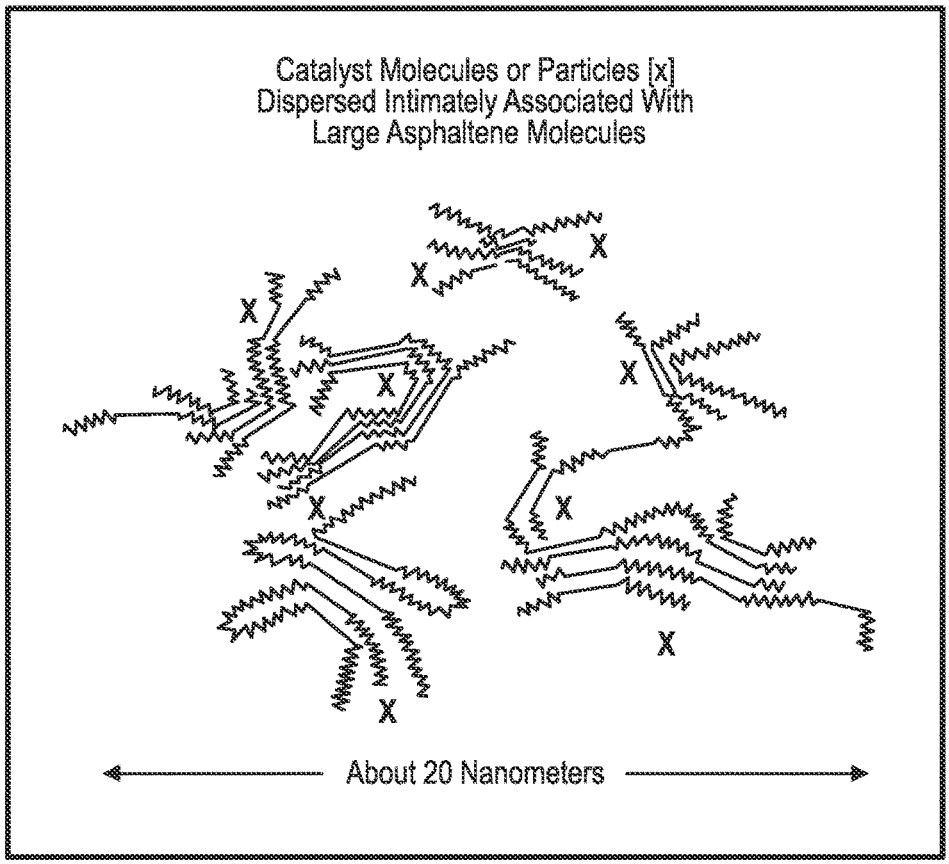
FIG. 6 schematically illustrates catalyst molecules or colloidal-sized catalyst particles associated with asphaltene molecules.

Notwithstanding the generally hydrophobic nature of heavy oil feedstocks, because asphaltene molecules generally have a large number of oxygen, sulfur and nitrogen functional groups, as well as associated metal constituents such as nickel and vanadium, the asphaltene fraction is significantly less hydrophobic and more hydrophilic than other hydrocarbons within the feedstock. Asphaltene molecules therefore generally have a greater affinity for the polar metal sulfide catalyst, particularly when in a colloidal or molecular state, compared to more hydrophobic hydrocarbons in a heavy oil feedstock. As a result, a significant portion of the polar metal sulfide molecules or colloidal particles tend to become associated with the more hydrophilic and less hydrophobic asphaltene molecules compared to the more hydrophobic hydrocarbons in the feedstock. The close proximity of the catalyst particles or molecules to the asphaltene molecules helps promote beneficial upgrading reactions involving free radicals formed through thermal cracking of the asphaltene fraction. This phenomenon is particularly beneficial in the case of heavy oils that have relatively high asphaltene content, which are otherwise difficult, if not impossible, to upgrade using conventional hydroprocessing techniques due to the tendency of asphaltenes to deactivate porous supported catalysts and deposit coke and sediments on or within the processing equipment. FIG. 6 schematically depicts catalyst molecules, or colloidal particles "X" associated with, or in close proximity to, the asphaltene molecules.

While the highly polar nature of the catalyst compound causes or allows the colloidal and/or molecular catalyst to associate with asphaltene molecules, it is the general incompatibility between the highly polar catalyst compound and the hydrophobic heavy oil feedstock that necessitates the aforementioned intimate or thorough mixing of the oil soluble catalyst precursor composition within the heavy oil feedstock prior to decomposition of the precursor and formation of the colloidal or molecular catalyst. Because metal catalyst compounds are highly polar, they cannot be effectively dispersed within a heavy oil feedstock in colloidal or molecular form if added directly thereto or as part of an aqueous solution or an oil and water emulsion. Such methods inevitably yield micron-sized or larger catalyst particles.

Figure 7A:
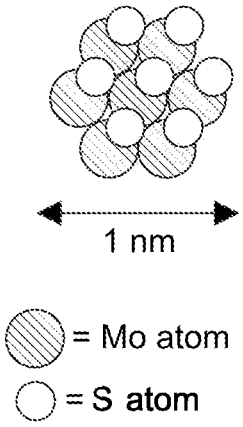
FIG. 7A schematically depicts a top view of a molybdenum disulfide crystal approximately 1 nm in size.
Figure 7B:
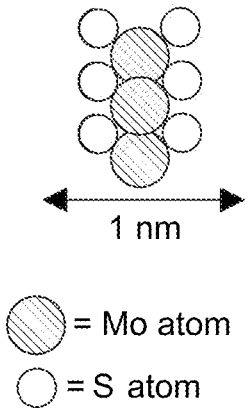
FIG. 7B schematically depicts a side view of a molybdenum disulfide crystal approximately 1 nm in size.

Reference is now made to FIGS. 7A and 7B, which schematically depict a nanometer-sized molybdenum disulfide crystal. FIG. 7A is a top view, and FIG. 7B is a side view of a molybdenum disulfide crystal. Molecules of molybdenum disulfide typically form flat, hexagonal crystals in which single layers of molybdenum (Mo) atoms are sandwiched between layers of sulfur (S) atoms. The only active sites for catalysis are on the crystal edges where the molybdenum atoms are exposed. Smaller crystals have a higher percentage of molybdenum atoms exposed at the edges.

The diameter of a molybdenum atom is approximately 0.3 nm, and the diameter of a sulfur atom is approximately 0.2 nm. The illustrated nanometer-sized crystal of molybdenum disulfide has 7 molybdenum atoms sandwiched in between 14 sulfur atoms. As best seen in FIG. 7A, 6 out of 7 (85.7%) of the total molybdenum atoms will be exposed at the edge and available for catalytic activity. In contrast, a micron-sized crystal of molybdenum disulfide has several million atoms, with only about 0.2% of the total molybdenum atoms being exposed at the crystal edge and available for catalytic activity. The remaining 99.8% of the molybdenum atoms in the micron-sized crystal are embedded within the crystal interior and are therefore unavailable for catalysis. This means that nanometer-sized molybdenum disulfide particles are, at least in theory, orders of magnitude more efficient than micron-sized particles in providing active catalyst sites.

In practical terms, forming smaller catalyst particles results in more catalyst particles and more evenly distributed catalyst sites throughout the feedstock. Simple mathematics dictates that forming nanometer-sized particles instead of micron-sized particles will result in approximately $1000^3$ (i.e., 1 million) to $1000^6$ (i.e., 1 billion) times more particles depending on the size and shape of the catalyst crystals. That means there are approximately 1 million to 1 billion times more points or locations within the feedstock where active catalyst sites reside. Moreover, nanometer-sized or smaller molybdenum disulfide particles are believed to become intimately associated with asphaltene molecules, as shown in FIG. 6. In contrast, micron-sized or larger catalyst particles are believed to be far too large to become intimately associated with or within asphaltene molecules. For at least these reasons, the distinct advantages associated with the mixing method and system that provides for formation of a colloidal and/or molecular catalyst will be apparent to one skilled in the art.

V. Examples

The following examples more particularly illustrate exemplary hydrocracking systems in which the upgraded effluent material from a first gas-liquid two-phase hydrocracking reactor is separated into a lower boiling volatile gaseous vapor fraction and a higher boiling liquid fraction before introducing the higher boiling liquid fraction into a second gas-liquid two-phase hydrocracking reactor, which causes the catalyst to concentrate within the liquid fraction in preparation for further hydroproces sing of this fraction. All percentages are mole percent unless specified otherwise.

Comparative Example A

The effectiveness of the inventive hydroprocessing reactor system designs were compared. The baseline comparison reactor system design is similar to that shown in FIG. 4, except that all effluent from first reactor 122' is fed into second reactor 138' (i.e., no flow in stream **130*b*'**). A heavy oil feedstock comprising 75 ppm of a molybdenum disulfide catalyst in colloidal or molecular form is introduced into a first gas-liquid two-phase reactor having dimensions of about 5.0 m OD and a capacity of about 30,000 barrels per stream day (BPSD).

Example 1

A reactor system design similar to that shown in FIG. 4 is evaluated. A heavy oil feedstock comprising about 75 ppm of a molybdenum disulfide catalyst in colloidal or molecular form is introduced into a first gas-liquid two-phase reactor having dimensions of about 5.0 m OD and a capacity of about 30,000 barrels per stream day (BPSD). Effluent from second two-phase reactor 138' includes smaller fractions of lower boiling components, including less $C_1$ to $C_4$ hydrocarbons and $H_2S$ relative to Comparative Example A. The catalyst concentration within stream **130*a*' is greater than the catalyst concentration exiting the first reactor of Comparative Example A (e.g., at least about 10 percent higher). Within second reactor 138', there are less gaseous products, less required $H_2$ flow, less gas hold up (because a larger fraction of the material within the reactor are liquid components requiring hydrocracking), and higher catalyst concentration relative to the composition within the second reactor of Comparative Example A. In addition, second reactor 138' may be smaller than in Comparative Example A, or alternatively, the system may be designed with the same reactor volume and increased conversion (i.e., lower fraction of unconverted asphaltene/resid material exiting from second reactor 138'**) as compared to Comparative Example A.

Example 2

A reactor system design similar to that shown in FIG. 5 is evaluated. A heavy oil feedstock comprising about 75 ppm of a molybdenum disulfide catalyst in colloidal or molecular form is introduced into a first gas-liquid two-phase reactor having dimensions of about 5.0 m OD and a capacity of about 30,000 barrels per stream day (BPSD). Stream **131*a*' introduced into second two-phase reactor 138' is much greater than the initial concentration of 75 ppm (e.g., about 25 percent to about 40 percent higher). Effluent from second two-phase reactor 138' includes smaller fractions of lower boiling components, including less $C_1$ to $C_4$ hydrocarbons and less $H_{25}$ relative to Comparative Example A and Example 1. Within second reactor 138', there are less gaseous products, less required $H_2$ flow, less gas hold up (because a larger fraction of the material within the reactor are liquid components requiring hydrocracking), and higher catalyst concentration relative to the compositions within the second reactors of Comparative Example A and Example 1. In addition, second reactor 138' may be smaller than the second reactors in Comparative Example A and Example 1. Alternatively, the system may be designed with the same reactor volume and increased conversion (i.e., lower fraction of unconverted asphaltene/resid material exiting from second reactor 138') as compared to Comparative Example A and Example 1. The pressure of stream 130*b*' is significantly greater (e.g., 100 to 1000 psi greater, for example 400 psi greater) than stream 131*b*', which is may be slightly greater (e.g., less than 25 psi greater, more typically less than 10 psi greater) than the pressure of stream 129'**.

Example 3

A reactor system design similar to that shown in FIG. 3 is evaluated. A heavy oil feedstock comprising about 75 ppm of a molybdenum disulfide catalyst in colloidal or molecular form is introduced into a first gas-liquid two-phase reactor having dimensions of about 5.0 m OD and a capacity of about 30,000 barrels per stream day (BPSD). Stream 136 introduced into second two-phase reactor 138 is much greater than the initial concentration of 75 ppm (e.g., at least about 20 percent higher). Effluent 140 from second two-phase reactor 138 includes smaller fractions of lower boiling components, including less $C_1$ to $C_4$ hydrocarbons and less $H_{25}$ relative to Comparative Example A and Example 1. Within second reactor 138, there are less gaseous products, less required $H_2$ flow, less gas hold up (because a larger fraction of the material within the reactor are liquid components requiring hydrocracking), and higher catalyst concentration relative to the compositions within the second reactors of Comparative Example A and Example 1. In addition, second reactor 138 may be smaller than the second reactors in Comparative Example A and Example 1. Alternatively, the system may be designed with the same reactor volume and increased conversion (i.e., lower fraction of unconverted asphaltene/resid material 140 exiting from second reactor 138) as compared to Comparative Example A and Example 1. The pressure of stream 134 is significantly (e.g., about 400 psi greater) greater than streams 140 and 129.

Example 4

Any of the foregoing examples is modified by adding or forming an additional quantity of colloidal or molecular catalyst within the liquid feedstream that is introduced into and/or processed within the second or other downstream reactor(s).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of hydrocracking a heavy oil feedstock using a colloidal or molecular catalyst, comprising:

introducing an entirety of a heavy oil feedstock including a colloidal or molecular catalyst and/or catalyst precursor into a first hydrocracking reactor, the first hydrocracking reactor having a first concentration of colloidal or molecular catalyst and producing an effluent;

separating the effluent produced by the first hydrocracking reactor into a lower boiling vapor fraction and a higher boiling liquid fraction, the higher boiling liquid fraction including residual colloidal or molecular catalyst;

after separating the effluent into the lower boiling vapor fraction and the higher boiling liquid fraction, adding an additional quantity of colloidal or molecular catalyst and/or catalyst precursor to the higher boiling liquid fraction to supplement the residual colloidal or molecular catalyst; and introducing at least a portion of the higher boiling liquid fraction as sole heavy oil feed into a second hydrocracking reactor, the higher boiling liquid fraction introduced as sole heavy oil feed into the second hydrocracking reactor having a lower volume and quality than the heavy oil feedstock introduced into the first hydrocracking reactor, the second hydrocracking reactor having a higher concentration of colloidal or molecular catalyst than the first concentration of colloidal or molecular catalyst within the first hydrocracking reactor.

2. A method as recited in claim 1, wherein adding an additional quantity of colloidal or molecular catalyst and/or catalyst precursor to the higher boiling liquid fraction comprises combining a colloidal or molecular catalyst and/or a catalyst precursor composition with the higher boiling liquid fraction prior to introducing the higher boiling liquid fraction into the second hydrocracking reactor.

3. A method as recited in claim 1, wherein adding an additional quantity of colloidal or molecular catalyst and/or catalyst precursor to the higher boiling liquid fraction comprises pre-blending a catalyst precursor composition with a hydrocarbon diluent to form a catalyst precursor mixture and combining the catalyst precursor mixture with the higher boiling liquid fraction prior to introducing the higher boiling liquid fraction into the second hydrocracking reactor.

4. A method as recited in claim 1, wherein separating the effluent produced from the first hydrocracking reactor is carried out using a pressure differential interstage separator which induces a significant pressure drop so as to separate the lower boiling volatile gaseous vapor fraction from the higher boiling liquid fraction.

5. A method as recited in claim 4, wherein adding an additional quantity of colloidal or molecular catalyst and/or catalyst precursor to the higher boiling liquid fraction comprises introducing a colloidal or molecular catalyst and/or a catalyst precursor composition into the pressure differential interstage separator.

6. A method as recited in claim 4, wherein adding an additional quantity of colloidal or molecular catalyst and/or catalyst precursor to the higher boiling liquid fraction comprises pre-blending a catalyst precursor composition with a hydrocarbon diluent to form a catalyst precursor mixture and introducing the catalyst precursor mixture into the pressure differential interstage separator.

7. A method as recited in claim 4, wherein the pressure drop is between about 100 psi to about 1000 psi.

8. A method as recited in claim 4, wherein the pressure drop is between about 200 psi to about 700 psi.

9. A method as recited in claim 4, wherein the pressure drop is between about 300 psi to about 500 psi.

10. A method as recited in claim 1, wherein all of the higher boiling liquid fraction is introduced into the second hydrocracking reactor.

11. A method as recited in claim 1, wherein a portion of the higher boiling liquid fraction is recycled back into the first hydrocracking reactor.

12. A method as recited in claim 1, further comprising separating a second effluent produced by the second hydrocracking reactor into a second lower boiling vapor fraction and a second higher boiling liquid fraction and introducing at least a portion of the second higher boiling liquid fraction into a third hydrocracking reactor and wherein the second higher boiling liquid fraction has a concentration of colloidally or molecularly dispersed catalyst that is greater than the concentration of colloidally or molecularly dispersed catalyst within the second hydrocracking reactor.

13. A method as recited in claim 12, further comprising adding a second additional quantity of colloidal or molecular catalyst and/or catalyst precursor to the second higher boiling liquid fraction.

14. A method as recited in claim 13, wherein adding a second additional quantity of colloidal or molecular catalyst and/or catalyst precursor to the second higher boiling liquid fraction comprises combining a catalyst precursor composition with the higher boiling liquid fraction prior to introducing the higher boiling liquid fraction into the second hydrocracking reactor.

15. A method as recited in claim 13, wherein adding a second additional quantity of colloidal or molecular catalyst and/or catalyst precursor to the second higher boiling liquid fraction comprises pre-blending a catalyst precursor composition with a hydrocarbon diluent to form a second catalyst precursor mixture and combining the second catalyst precursor mixture with the second higher boiling liquid fraction prior to introducing the second higher boiling liquid fraction into the third hydrocracking reactor.

16. A method as recited in claim 12, wherein separating the second effluent produced by the second hydrocracking reactor is carried out using an interstage pressure differential separator which induces a pressure drop so as to separate the second lower boiling volatile gaseous vapor fraction from the second higher boiling liquid fraction.

17. A method as recited in claim 1, wherein the higher boiling liquid fraction introduced into the second hydrocracking reactor has a concentration of colloidal or molecular catalyst that is at least about 10 percent higher than a concentration of colloidal or molecular catalyst within the first hydrocracking reactor.

18. A method as recited in claim 1, wherein the higher boiling liquid fraction introduced into the second hydrocracking reactor has a concentration of colloidal or molecular catalyst that is at least about 25 percent higher than a concentration of colloidal or molecular catalyst within the first hydrocracking reactor.

19. A method as recited in claim 1, wherein the higher boiling liquid fraction introduced into the second hydrocracking reactor has a concentration of colloidal or molecular catalyst that is at least about 30 percent higher than a concentration of colloidal or molecular catalyst within the first hydrocracking reactor.

20. A method of hydrocracking a heavy oil feedstock using a colloidal or molecular catalyst, comprising:

introducing an entirety of a heavy oil feedstock including a colloidal or molecular catalyst and/or catalyst precursor into a first hydrocracking reactor, the first hydrocracking reactor having a first concentration of colloidal or molecular catalyst and producing an effluent;

introducing the effluent produced by the first hydrocracking reactor through a valve and into a pressure differential interstage separator which induces a pressure drop and separates a lower boiling volatile gaseous vapor fraction from a higher boiling liquid fraction, the higher boiling liquid fraction including residual colloidal or molecular catalyst;

adding an additional quantity of colloidal or molecular catalyst and/or catalyst precursor to the higher boiling liquid fraction within the pressure differential interstage separator to supplement the residual colloidal or molecular catalyst; and introducing the higher boiling liquid fraction as sole heavy oil feed into a second hydrocracking reactor, the higher boiling liquid fraction introduced as sole heavy oil feed into the second hydrocracking reactor having a lower volume and quality than the heavy oil feedstock introduced into the first hydrocracking reactor, the second hydrocracking reactor having a concentration of colloidal or molecular catalyst that is greater than the first concentration of colloidal or molecular catalyst within the first hydrocracking reactor.

21. A method of hydrocracking a heavy oil feedstock using a colloidal or molecular catalyst, comprising:

introducing an entirety of a heavy oil feedstock including a colloidal or molecular catalyst and/or catalyst precursor into a first hydrocracking reactor, the first hydrocracking reactor having a first concentration of colloidal or molecular catalyst and producing an effluent;

introducing the effluent produced by the first hydrocracking reactor through a valve and into a pressure differential interstage separator to induce a pressure drop and separate a lower boiling volatile gaseous vapor fraction from a higher boiling liquid fraction, the higher boiling liquid fraction including residual colloidal or molecular catalyst;

removing the higher boiling liquid fraction from the interstage separator and adding an additional quantity of colloidal or molecular catalyst and/or catalyst precursor to the higher boiling liquid fraction removed from the interstage separator to supplement the residual colloidal or molecular catalyst; and introducing at least a portion of the higher boiling liquid fraction as sole heavy oil feed into a second hydrocracking reactor, the higher boiling liquid fraction introduced as sole heavy oil feed into the second hydrocracking reactor having a lower volume and quality than the heavy oil feedstock introduced into the first hydrocracking reactor, the second hydrocracking reactor having a concentration of colloidal or molecular catalyst that is greater than the first concentration of colloidal or molecular catalyst within the first hydrocracking reactor.

22. A method as recited in claim 1, wherein adding an additional quantity of colloidal or molecular catalyst and/or catalyst precursor to the higher boiling liquid fraction comprises introducing a colloidal or molecular catalyst and/or a catalyst precursor composition directly into the second hydrocracking reactor.

23. A method as recited in claim 1, wherein adding an additional quantity of colloidal or molecular catalyst and/or catalyst precursor to the higher boiling liquid fraction comprises introducing a colloidal or molecular catalyst and/or a catalyst precursor composition into a separator used to separate the effluent produced by the first hydrocracking reactor into the lower boiling vapor fraction and the higher boiling liquid fraction and/or at a location downstream from the separator and upstream from the second hydrocracking reactor.

24. A method as recited in claim 20, wherein adding an additional quantity of colloidal or molecular catalyst and/or catalyst precursor to the higher boiling liquid fraction comprises pre-blending a catalyst precursor composition with a hydrocarbon diluent to form a catalyst precursor mixture and adding the catalyst precursor mixture to the pressure differential interstage separator.

25. A method as recited in claim 21, wherein adding an additional quantity of colloidal or molecular catalyst and/or catalyst precursor to the higher boiling liquid fraction comprises introducing a colloidal or molecular catalyst and/or a catalyst precursor composition directly into the second hydrocracking reactor.

* * * * *